US008183789B2

(12) United States Patent
Mantovani

(10) Patent No.: US 8,183,789 B2
(45) Date of Patent: May 22, 2012

(54) LIGHTING SYSTEM FOR AVIONICS APPLICATIONS AND CONTROL METHOD THEREOF

(75) Inventor: Luca Mantovani, Montevarchi (IT)

(73) Assignee: Sirio Panel S.p.A., Montevarchi (IT)

( * ) Notice: Subject to any disclaimer, the term of this patent is extended or adjusted under 35 U.S.C. 154(b) by 552 days.

(21) Appl. No.: 12/408,661

(22) Filed: Mar. 20, 2009

(65) Prior Publication Data

US 2009/0267538 A1 Oct. 29, 2009

(30) Foreign Application Priority Data

Mar. 20, 2008 (EP) ..... 08153163

(51) Int. Cl.
*H05B 37/02* (2006.01)

(52) U.S. Cl. ..... 315/291; 315/297; 315/307

(58) Field of Classification Search ..... 315/247, 315/291, 294, 297, 307–308, 312, 360
See application file for complete search history.

(56) References Cited

U.S. PATENT DOCUMENTS

| | | | | |
|---|---|---|---|---|
| 6,687,138 | B1 | 2/2004 | Poindexter | |
| 7,294,970 | B2 * | 11/2007 | Yang | 315/158 |
| 2003/0222587 | A1 | 12/2003 | Dowling, Jr. et al. | |
| 2005/0168168 | A1 | 8/2005 | Elliott | |
| 2006/0186830 | A1 * | 8/2006 | Shami et al. | 315/291 |
| 2006/0187081 | A1 | 8/2006 | Gloisten et al. | |
| 2006/0239689 | A1 | 10/2006 | Ashdown | |
| 2007/0139316 | A1 * | 6/2007 | Hyatt | 345/82 |
| 2008/0048573 | A1 | 2/2008 | Ferentz et al. | |
| 2008/0297067 | A1 * | 12/2008 | Wang et al. | 315/294 |
| 2009/0230891 | A1 * | 9/2009 | Zhao et al. | 315/308 |
| 2011/0018465 | A1 * | 1/2011 | Ashdown | 315/294 |

OTHER PUBLICATIONS

Extended European Search Report for EP Counterpart Patent No. 08153163.4, 3 pgs. (May 16, 2008).
Extended European Search Report for European Application No. 10163658.7 containing Communication Relating to the Results of the European Search Report, Jul. 14, 2010, 4 pages.

* cited by examiner

*Primary Examiner* — Douglas W Owens
*Assistant Examiner* — Tung X Le
(74) *Attorney, Agent, or Firm* — Blakely, Sokoloff, Taylor & Zafman LLP.

(57) ABSTRACT

Disclosed herein is a lighting system, in particular for an avionics apparatus, having at least a light source and a control unit coupled to the light source and controlling operation thereof based on a management PWM signal; the management PWM signal may have a shape such as to limit radio frequency emissions. According to an embodiment, the lighting system has an interface unit coupled to the light source and receiving the management PWM signal from the control unit; during a lighting management mode, the management PWM signal carries management information for controlling the light source, and the interface unit is operable to decode the management information, for driving the light source; in particular, the control unit codes the management information using a first waveform parameter of the management PWM signal, and at least a second waveform parameter of the management PWM signal, different from the first waveform parameter. According to a further embodiment, the lighting system has at least one storage element coupled to the light source, and a transmission protocol is associated to the management PWM signal, envisaging a bidirectional communication between the control unit and the interface unit, by means of which management data are read from, and/or written to, the storage element.

36 Claims, 17 Drawing Sheets

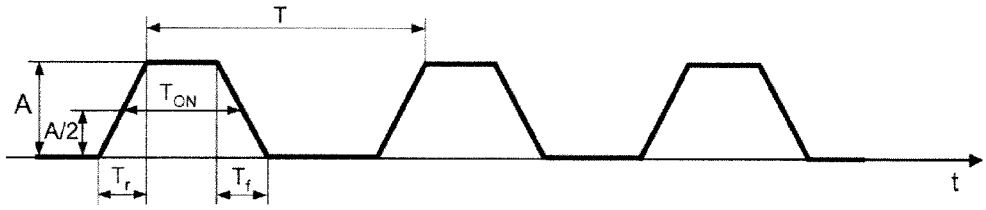
Fig.2a
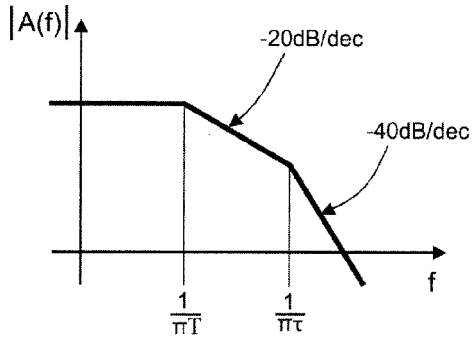
Fig.2b
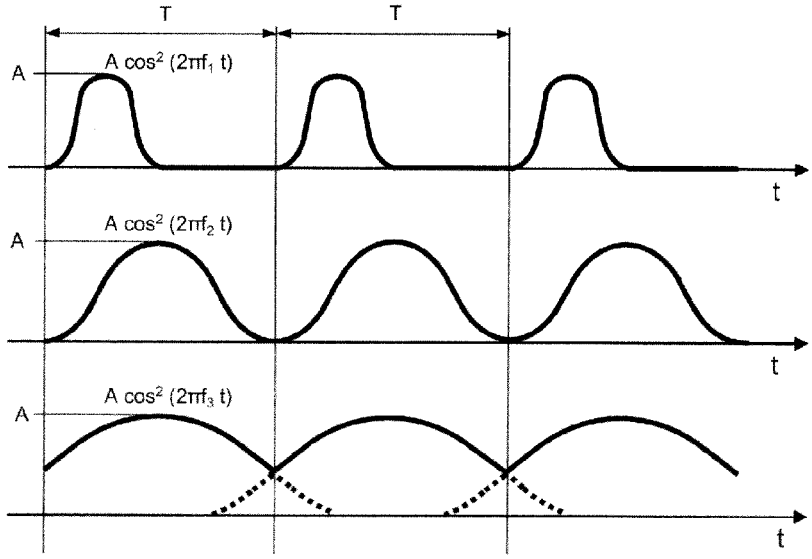
Fig.3a
Fig.3b
Fig.3c

LIGHTING SYSTEM FOR AVIONICS APPLICATIONS AND CONTROL METHOD THEREOF

TECHNICAL FIELD OF THE INVENTION

The present invention relates in general to a lighting system, and more particularly to a LED lighting system for avionics applications managed by PWM (Pulse Width Modulated) management signals, and to a method for controlling the same lighting system.

BACKGROUND ART

As is known, use of LED (Light Emitting Diode) light sources is increasingly growing in various fields of application (e.g. automotive, home automation, consumer and industrial electronics, etc.), due to their high efficiency and low consumption.

In particular, LEDs are nowadays widely used in avionics applications, as light sources in cockpit lighting systems. LEDs are used in a plurality of equipments inside the cockpit, for example as backlight for displays, in warnings or advisory annunciators lighted panels, lighted control keys, etc. By means of dedicated actuators (e.g. switches or potentiometers) arranged inside the cockpit, personnel of the crew may adjust brightness of the light sources, and select a lighting mode, e.g. a 'BRIGHT mode' corresponding to a maximum brightness for daylight sun condition, a 'DIM mode' corresponding to a minimum brightness for night condition, or an 'NVG mode' corresponding to a brightness value suitable for use with night vision goggles. In a known architecture, commands imparted by the user are received by a control unit of the lighting system (generally known as "Dimming Control Unit" or DMCU), which is configured to process the information received, and to generate control and/or driving signals (in general, management signals) necessary to manage the light sources of the various equipments in the cockpit.

Pulse width modulation has proven to be a reliable solution for varying the intensity of the light emitted by LED light sources gradually (operation commonly known as "dimming"), and envisages the use of square wave signals having a variable duty cycle. The light emitted by a LED is a substantially linear function of the duty cycle of the PWM driving waveform, and also shows a non-linear dependency on the amplitude of the same waveform; dimming can thus be achieved by variation of either the duty cycle or the amplitude of the PWM signal, or both. However, due to the fact that typically a uniform spectrum of emission is required and the amplitude of the driving signal influences the colour of the emitted light, and that noise and environmental disturbances may easily affect the amplitude information, it is commonly preferred to achieve dimming by using PWM square wave signals having fixed amplitude and variable duty cycle.

Management signals transmitted from the DMCU to the various equipments and corresponding light sources may include: PWM control signals, i.e. PWM signals (usually voltage signals) having a low or very low current capability, and a duty cycle that is adjusted based on the desired brightness level (i.e. the duty cycle "codes" the brightness information); discrete control signals (usually logic signals having two discrete logic values), that are associated to the control signals and carry control information such as the desired lighting mode (BRIGHT, DIM, NVG), or test information (TEST); and PWM driving signals (either voltage or current signal), i.e. PWM signals with low, medium or high power capability adapted to directly drive a LED light source according to the desired brightness and lighting mode, and thus having suitable amplitude and duty cycle values. Each equipment is provided with a decoding interface, adapted to receive the PWM and discrete control signals in order to decode duty cycle and amplitude information therefrom; and with an internal driver, adapted to generate a PWM driving signal to drive the internal light source (or light sources in the event that the equipment is provided with a plurality of light sources) based on the decoded information. The decoding interface and internal driver are bypassed, if PWM driving signals are exchanged between the DMCU and the equipment (the PWM driving signal energy is used to directly drive the light sources). In particular, the decoding interface may include a memory, and the PWM and discrete control signals define the address of a look-up table where the values of duty cycle and amplitude for driving the LED light sources are stored. The internal driver supplies the LED light sources with a controlled current, either generating a current waveform, or generating a voltage waveform through a resistor (normally present on the load side).

The requirements of a cockpit lighting system are very stringent about optical performances. In particular, it is necessary to provide: high brightness dynamic to guarantee optimal visibility in very different light conditions (e.g. in sun condition and during night flight with night vision goggles, in military applications); accurate optical spectrum control to guarantee stable and correct colour and reduced emitted energy (radiance); and high light uniformity among different regions inside the cockpit, and among the different equipments and light sources. Moreover, avionics lighting system should comply with the general requirements of avionics applications, among which: weight control and reduction; power loss reduction and current consumption limitation; maintainability and easy testability; flexibility and reliability; and compliance with EMC constraints (in terms of emission and susceptibility).

In particular, radio frequency (RF) immunity is a very critical parameter for avionics applications. Equipments must pass severe susceptibility tests, in the presence of high frequency energy injection on the equipment cables (conducted susceptibility), or high energy radiated field (radiated susceptibility). These immunity requirements are mainly due to the field of application; the extended glass surface allowing a very high radiated field directly inside the cockpit when the aircraft or helicopter is lighted by an external radar; the number of equipments inside the cockpit that can radiate energy and cause functional problems on other units with low susceptibility threshold level; and the coupling with interconnection cables and power lines.

It is clear that all the above requirements make the design of an avionics lighting system a delicate and complex task. The use of LED light sources and PWM control has allowed to meet most of the above requirements. However, some problems still limit the potentiality of avionics LED lighting systems, among which are those related to system complexity in terms of the total amount of wirings and signaling between the DMCU and cockpit equipments.

In particular, current solutions to limit RF emissions envisage the use of either shielding cables or of twisted (or balanced, or symmetric) pairs to carry signals from the DMCU to the various equipments, to the detriment of cabling complexity, weight and manufacturing costs.

Generation of the driving signals for the light sources internally to the various equipments may improve robustness against RF disturbances and electromagnetic interference, since control signals transmitted from the DMCU may have parameters optimized to comply with EMC requirements.

However, this kind of solution requires a huge amount of cabling between the DMCU and the equipments of the lighting system, again to the detriment of system complexity, weight and manufacturing costs. In particular, at least one PWM control signal (to control the brightness level with duty cycle coding) and a number of discrete control signals (each corresponding to a desired lighting mode) are to be exchanged between the DMCU and the various types of light sources inside each equipment. Considering that inside the cockpit it is common to have hundreds of light sources (belonging in groups to different equipments), it is clear that wiring complexity may become an important issue.

The above wiring complexity problem is even more evident if the possibility to test the functionality of the various equipments is to be provided (as it is required in the majority of avionics applications). In this case, at least a further discrete control signal for each light source must be provided to allow an exchange of status information with the DMCU.

OBJECT AND SUMMARY OF THE INVENTION

From the foregoing, it is evident that the need is surely felt for a lighting system for avionics applications that will allow the aforementioned drawbacks to be at least in part overcome, and in particular will show improved properties with respect to system and wiring complexity.

This objective is achieved by the present invention in that it relates to a lighting system and to a related control method, as claimed in the attached claims.

In particular, one embodiment of the present invention envisages the use of at least one further waveform parameter of the PWM control signals, other than the duty cycle (used to transfer the brightness information), to transfer at least a further information for managing the lighting system. Moreover, the use of a dedicated protocol is proposed in order to further increase the information content associated to the PWM control signals transmitted from the DMCU to the various equipments. Use of complex coding schemes allow to reduce the number of signal cables to just one cable between the DMCU and each of the equipments, thus allowing a great reduction of system complexity, weight and costs.

Another embodiment of the present invention envisages the implementation of a bidirectional communication between the DMCU and the equipments, using the PWM control signals associated to a write/read protocol. In particular, during maintenance operations, information may be read from, or written to, memory registers associated to the light sources. This solution allows to increase the maintainability and testability of the lighting system, without causing an increase in the wiring complexity (since no additional cables are required to transmit maintenance information).

A further embodiment of the present invention envisages the use of PWM signals having a low emission waveform with smooth rising and/or falling edges, e.g. made of the periodic repetition of trapezoidal or squared cosine waves. This allows to reduce RF emissions due to the switching pattern of the PWM control and driving signals present in the lighting system, so that complex wiring arrangements, such as shielding cables or balanced pairs are no more required; wiring complexity, weight of the system and costs are thus reduced.

The advantages of the proposed lighting system and method are particularly significant in LED lighting systems for avionics applications.

BRIEF DESCRIPTION OF THE DRAWINGS

For a better understanding of the present invention, preferred embodiments thereof, which are intended purely by way of example and are not to be construed as limiting, will now be described with reference to the attached drawings (all not drawn to scale), wherein:

FIGS. 2*a* and 2*b* show a trapezoidal PWM signal waveform used in the lighting system of FIG. 1, and, respectively, the associated spectrum;

FIGS. 3*a*-3*c* show squared cosine PWM signal waveform used in the lighting system of FIG. 1, having different duty-cycle values;

DETAILED DESCRIPTION OF PREFERRED EMBODIMENTS OF THE INVENTION

The following discussion is presented to enable a person skilled in the art to make and use the invention. Various modifications to the embodiments described will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein and defined in the attached claims.

Figure 1:
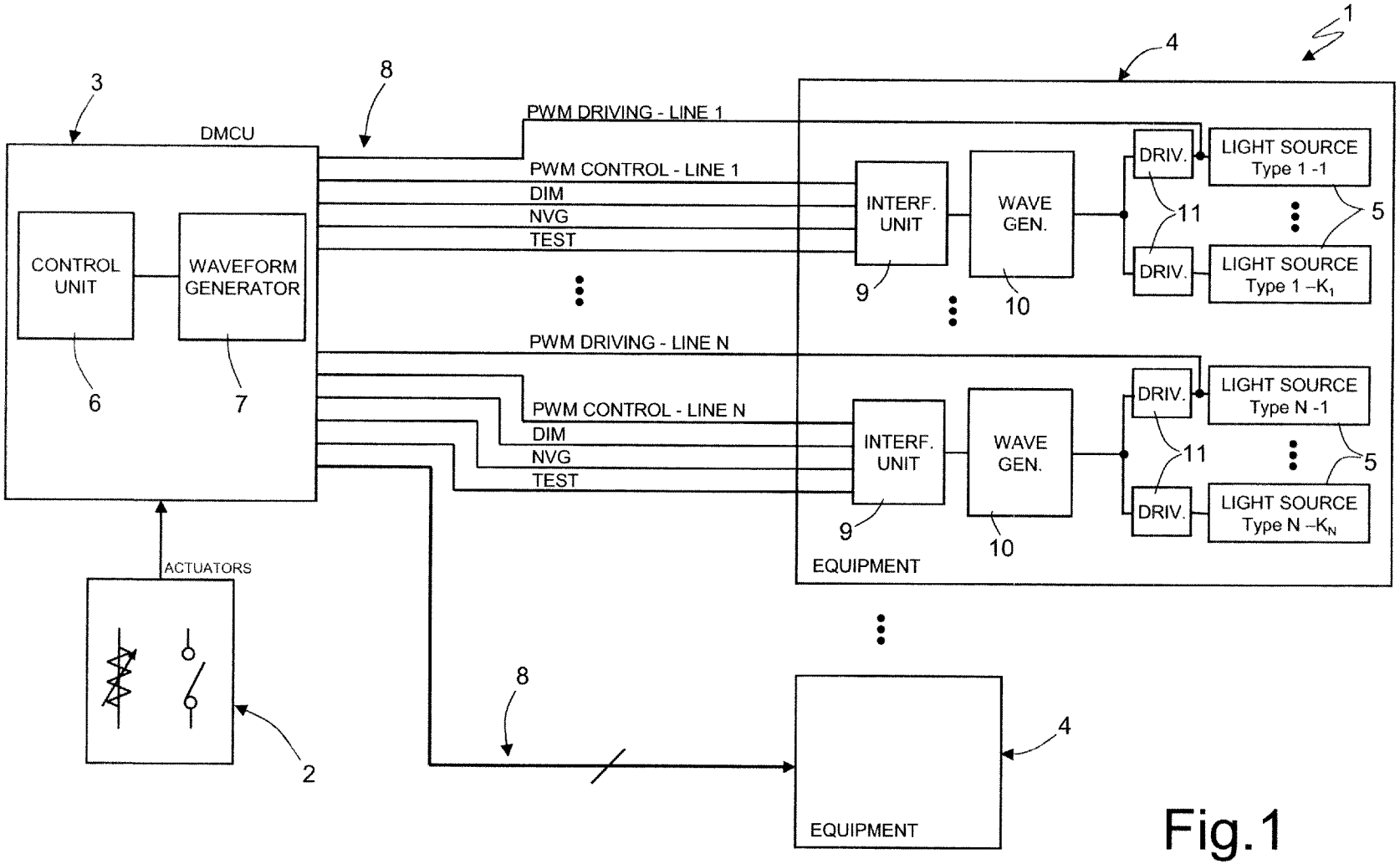
FIG. 1 shows a schematic block diagram of a lighting system for avionics application, according to an embodiment of the present invention.

FIG. 1 shows a lighting system according to an embodiment of the present invention, denoted in general with reference number 1.

Lighting system 1 includes a plurality of user actuating elements 2, shown schematically and comprising switches, potentiometers, buttons and the like, arranged in the cockpit so as to be actuatable by a user; a dimming control unit (DMCU) 3, coupled to the user actuating elements 2 and receiving from the user actuating elements 2 actuation signals due to their actuation; and a plurality of equipments 4 (only one of which is shown in detail), arranged in the cockpit and adapted to be managed by the DMCU 3, each including a number (N) of different types of light sources 5 (e.g. red, green and yellow light source types), usually requiring very different dimming levels and thus requiring dedicated control and driving lines.

In detail, the user actuating elements 2 are operable by the crew personnel to manage the lighting system 1, e.g. for adjusting the brightness of the various light sources 5 or selecting a particular lighting mode (or performing other management operations for the lighting system).

The DMCU 3 includes a control logic 6 (e.g. implemented by a microprocessor or other suitable logics), adapted to receive the actuation signals from the user actuating elements 2, and an external waveform generator 7, controlled by the control logic 6 in order to generate suitable management signals to be transmitted to the equipments 4. The management signals are (as previously discussed) PWM or discrete control signals, and/or PWM external driving signals, which are transmitted to each one of the equipments 4 through respective signal lines 8.

Each equipment 4 includes a number N of interface units 9 and corresponding internal waveform generators 10, the number N being equal to the number of light source types, and a number $K_i$ ($1<i<N$) of light sources 5, and associated drivers 11, for each light source type. Each interface unit 9 receives from the DMCU 3 a PWM control signal and a plurality of discrete control signals (in a number equal to the number of lighting modes, e.g. three discrete control signals for selection of a 'DIM' mode, an 'NVG' mode, and a 'TEST' mode, respectively), decodes the amplitude and duty cycle information associated to the received signals, and supplies amplitude and duty cycle values to the associated internal waveform generator 10. Each internal waveform generator 10 is associated to a given light source type, and generates an internal PWM driving signal for the light sources 5 of the given light source type, having duty cycle and amplitude corresponding to the received amplitude and duty cycle information. Drivers 11, e.g. current drivers, actually drive the respective light sources 5 with suitable current values (each driver 11 may also drive more than one light source 5, in this case drivers 11 being in a number less than the light sources 5).

As shown schematically in FIG. 1 for a single light source 5, light sources 5 of a given type may also receive directly from the DMCU 3 respective external PWM driving signals (thus bypassing the interface unit 9, waveform generator 10 and respective driver 11).

A first aspect of the present invention derives from the Applicant recognition that PWM signals are one of the main sources of RF emissions in known lighting systems; in particular, to the rise and fall times of the PWM signals are usually associated very high frequency emissions.

The use of dedicated PWM waveforms having a shape such as to limit RF emissions is thus proposed: PWM square waves (used in known systems) are replaced by low emission PWM waveforms having "soft", or "smooth", rising and/or falling edges (in contrast to the "abrupt" rising and falling edges of commonly used square waves). In particular, rising and falling edges are proposed having a given slope, determining significantly non-zero rise and fall times; this slope can be linear, sinusoidal, exponential, or have other "soft" shapes. The slope associated to the rise and fall times can be defined so as to limit high frequency emission, and to comply with the limits imposed by the standards (for example, in avionics application, the reference EMC standards are RTCA/DO-160 and MIL-STD-461/462). In particular, use of low emission PWM waveforms is proposed for PWM external and internal driving signals and for PWM control signals, both in the case of voltage and current signals.

External and internal waveform generators 7, 11 may for example be configured to generate PWM trapezoidal waveforms.

FIG. 2*a* shows such a PWM trapezoidal waveform: A denotes the amplitude of the waveform, T denotes the period of repetition, and $T_{ON}$ the ON portion of its duty cycle. In this case, linear slopes are associated to the rise time (denoted with $T_r$) and fall time (denoted with $T_f$), which are supposed to have an equal value $\tau$. As shown in FIG. 2*b*, the amplitude spectrum of the trapezoidal waveform shows a break point where the emissions decrease with a slope of 40 dB/dec, at frequency $1/\pi\cdot\tau$. Accordingly, shaping of the waveform allows to define suitable values for the rise and fall times, such as to achieve a desired attenuation pattern for RF emission (e.g. one with an attenuation slope of 40 dB/dec past a given frequency value).

FIGS. 3*a*-3*c* show other possible low emission PWM signals that may be generated by the external and internal waveform generators 7, 11, in particular trains of pulses having a squared cosine waveform (with duty cycle increasing from FIGS. 3*a* to 3*c*). If the period T of pulse repetition is fixed, duty cycle can be varied by varying the frequency f of the squared cosine waveform. Equivalent duty cycle of the PWM waveform may be calculated dividing the average amplitude on the period by the maximum amplitude value (denoted with A in FIGS. 3*a*-3*c*).

Figure 4:
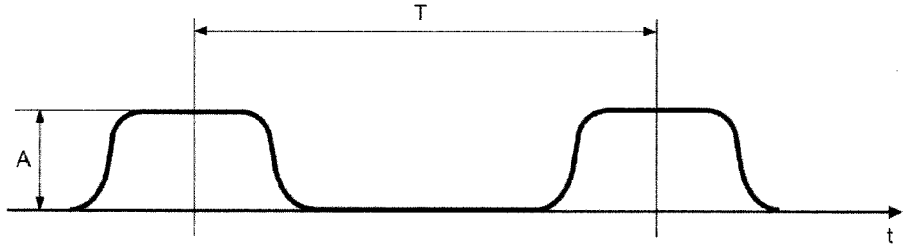
FIG. 4 shows a further variant of the PWM signal waveform used in the lighting system of FIG. 1.

FIG. 4 shows a further possible PWM waveform generated by the external and internal waveform generators 7, 11, made by the periodic repetition of pulses having squared cosine rising and falling edges and a flat top portion.

Other different low emission waveforms can be envisaged; in general terms, the more complex is the waveform, the greater the reduction in terms of RF emissions. However, while for ideal square waveforms, and also for trapezoidal waveforms, output brightness is proportional to the duty cycle, this may not be valid for complex waveforms, such as the cosine squared waveform; in this case, control logic 6 in the DMCU 3 will have to be configured to determine the required duty cycle value taking into account also the transfer function between the PWM complex shape and the output brightness.

Figure 5A:
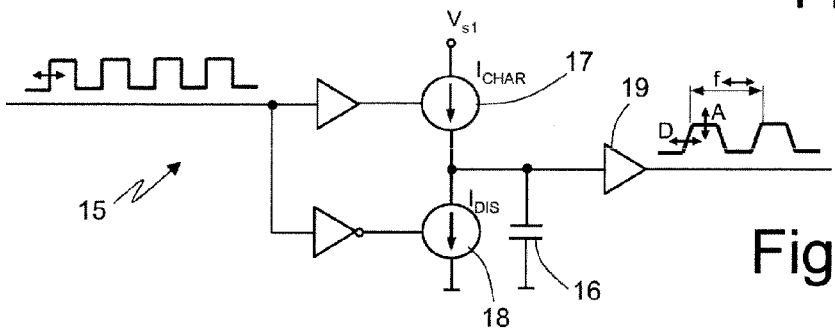
FIGS. 5*a*-5*d* show possible embodiments of a waveform generation circuit in the lighting system of FIG. 1.
Figure 5B:
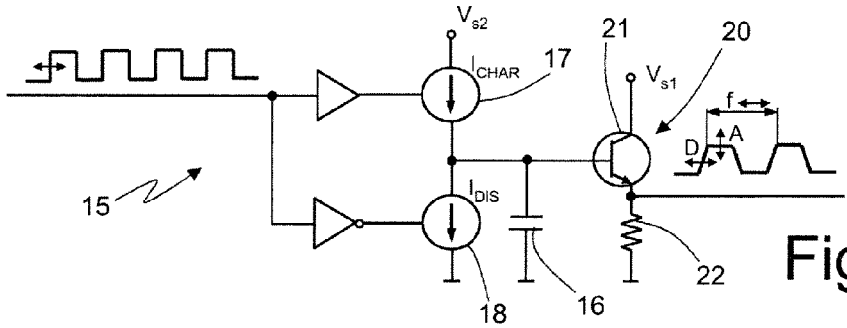
Figure 5C:
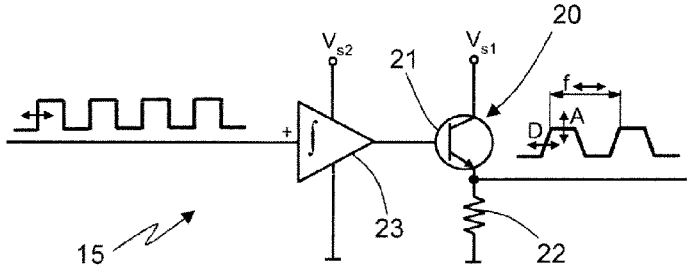

FIGS. 5*a*-5*c* show possible embodiments of a waveform generation circuit 15 in the external and internal waveform generators 7, 11, operable for generation of a PWM trapezoidal waveform; further details on some of these circuits can be found in co-pending European patent application 07425769.2 filed in the name of the present Applicant.

In detail, as shown in FIG. 5*a*, waveform generation circuit 15 includes a capacitor 16, and a first and second controlled current generators 17, 18, adapted to supply a charging current $I_{CHAR}$ to the capacitor 16, and, respectively, to draw a discharge current $I_{DIS}$ from the capacitor 16. First controlled current generator 17 receives a square wave with controllable duty cycle and frequency as a control signal, while second controlled current generator 18 receives the negated square wave as the control signal. First controlled current generator 17 receives a first supply voltage $V_{s1}$, that is variable in order to control the amplitude of the output signal. A current driver 19 is coupled to the capacitor 16 and supplies at the output of the waveform generation circuit 15 the desired trapezoidal waveform, having variable amplitude A, duty cycle D and frequency f.

During operation, capacitor 16 is charged by the charging current $I_{CHAR}$ supplied by the first controlled current generator 17, determining the linear rising edge of the trapezoidal output waveform, while the same capacitor 16 is discharged by the discharge current $I_{DIS}$ drawn by the second controlled current generator 18, determining the linear falling edge of the same trapezoidal output waveform. Capacitor 16 is charged up to the first supply voltage $V_{s1}$ minus the current driver saturation voltage.

According to a variant of the described circuit, as shown in FIG. 5*b*, the first controlled current generator 17 receives a second supply voltage $V_{s2}$ having a fixed value; variation of the trapezoidal waveform amplitude is achieved by an emitter follower stage 20, including a bipolar transistor 21 and a resistor 22. Bipolar transistor 21 has its base terminal coupled to the capacitor 16, its collector terminal receiving the first supply voltage $V_{s1}$ (that is variable in order to achieve amplitude control of the output signal), and its emitter terminal connected to the output of the waveform generation circuit 15 and to a reference potential via resistor 22. Operation of the circuit does not differ substantially from what described previously, so that the first supply voltage $V_{s1}$ determines the amplitude value obtained at the output; the transistor base voltage shall be greater than the output voltage, so as to saturate the bipolar transistor 21.

A further variant of the waveform generation circuit 15, shown in FIG. 5*c*, envisages the use of an integrator circuit 23 with saturation (e.g. a rail-to-rail operational amplifier), having an input receiving the control square wave, having controllable duty cycle and frequency, and an output connected to the emitter follower stage 20. In this case, the output trapezoidal waveform is obtained by integration of the control square wave, and its peak value is determined by the first supply voltage $V_{s1}$; the transistor base voltage shall be greater than the output voltage, so as to saturate the bipolar transistor 21.

Figure 5D:
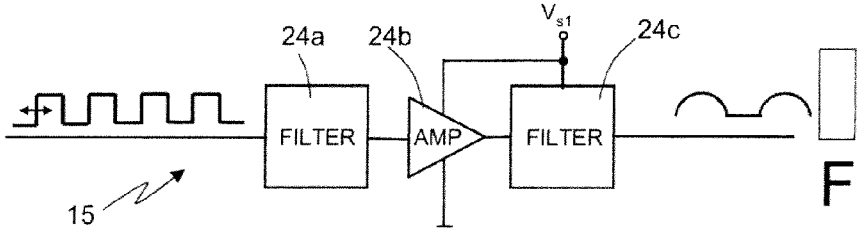

FIG. 5*d* shows a filtering circuit that optimizes the waveform frequency spectrum; this circuit is suitable for generation of low emissions waveforms in the lighting system. A square wave with variable duty cycle, received at the input, is filtered by an input filtering stage 24*a* to obtain a waveform with controlled frequency spectrum. Amplifier stage 24*b* and output filter stage 24*c* optimize the output signal (a pulse train with controlled spectrum), to drive an external load (e.g. a LED light source); the input or output filter stage 24*a*, 24*c* may include an high order filter to obtain a desired output waveform shape with very low emission for frequency greater than a filter cut-off frequency (e.g. having a frequency slope of 40 dB/dec past the cut-off frequency).

Complex waveforms may also be generated using a digital waveform generator, having a dedicated memory storing complex waveform samples. In this case, change of the conversion velocity modifies the waveform width and, as a consequence, the duty cycle (the repetition period being fixed).

Use of PWM signals with low emission waveforms greatly reduces RF emissions, and allows to simplify wirings and connections; in fact, a simple single wire may be used to transmit the PWM signals, without requiring the use of shielding cables or unbalanced pairs (twisted cables and the like).

Particular embodiments of the present invention envisage a further reduction of the wiring complexity, and in particular a great reduction of the number of signal lines used to transmit information from the DMCU 3 to the various equipments 4 inside the cockpit. The basic idea underlying these further embodiments is that of associating to the PWM control signals exchanged between the DMCU 3 and each of the equipments 4 not only the brightness information (coded, in a traditional manner, through the duty cycle value), but also additional information related to lighting system management. In particular, additional information is coded using further parameters of the PWM control signals, such as the amplitude or frequency parameters.

For simplicity of illustration, reference will be made in the following discussion and related drawings to "traditional" square wave PWM signals; nonetheless, it is to be understood that the combined use of PWM signals with low emission waveforms (e.g. a trapezoidal waveform) may clearly be envisaged and even suggested to optimize the overall performances of the lighting system. However, the described solution is clearly per se advantageous, even if "traditional" square wave PWM signals are used.

Figure 6:
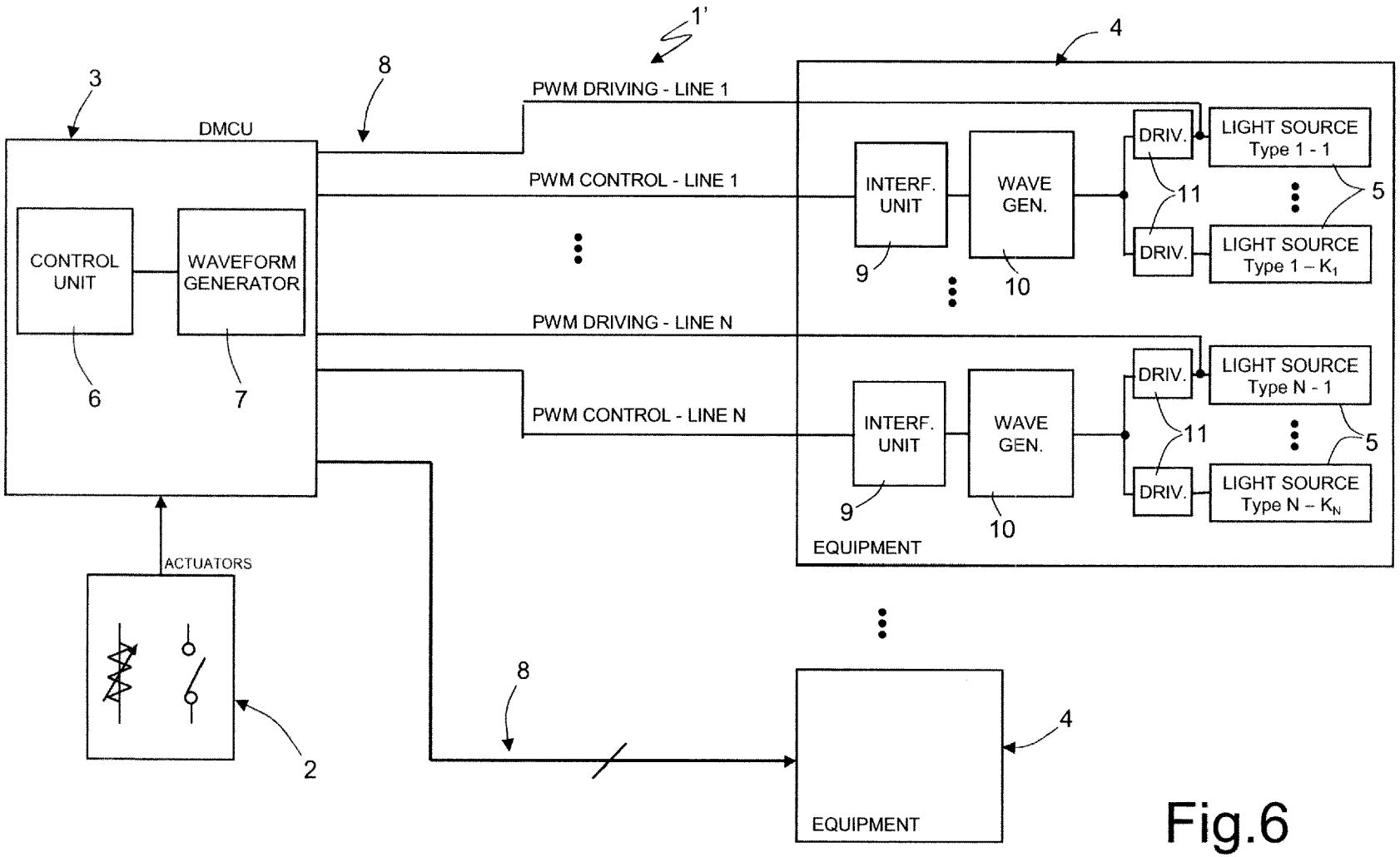
FIG. 6 shows a schematic block diagram of a lighting system for avionics application, according to an embodiment of the present invention.

An embodiment of the present invention will now be described, referred to as the "PWM simple coding" and envisaging the use of one additional parameter of the PWM control signals to code the lighting mode information to be transmitted to the equipments 4 (or any other status information that is traditionally transmitted via dedicated discrete signals). As will be clear from the following discussion, this solution allows to eliminate all discrete control signal lines reaching the various interface units 9 of the various equipments 4; the lighting system according to this embodiment, denoted with 1', is shown in FIG. 6, and corresponds to the lighting system 1 of FIG. 1, except for the absence of the discrete control signals.

In detail, lighting mode information is coded using either the amplitude level or the repetition frequency of the PWM control signal. Brightness information is still coded using the duty cycle of the same PWM control signal, in a traditional manner. Accordingly, if it is desired to have n lighting modes coded, n different amplitude levels or different frequencies of the PWM control signal can be used, to each one of them being associated univocally a respective lighting mode.

Figure 7A:
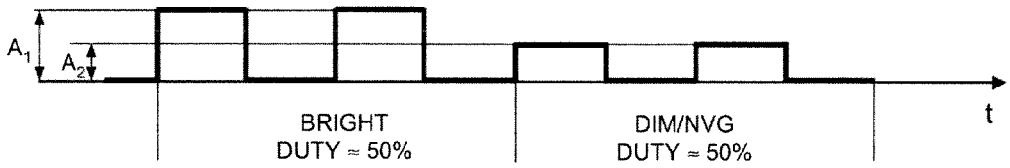
FIGS. 7*a* and 7*b* show an amplitude and, respectively, a frequency "simple coding" of a PWM control signal in the lighting system of FIG. 6.

FIG. 7*a* shows an example of amplitude coding of the PWM control signal, for a lighting system having two possible lighting modes (e.g. a 'BRIGHT' and a 'DIM and NVG' lighting mode). Two amplitude levels (denoted with $A_1$ and $A_2$) are used to code the lighting mode information, e.g. a 10V peak value is used to code the 'BRIGHT' lighting mode, and a 5V peak value is used to code the 'DIM/NVG' lighting mode. Duty cycle is used to code the brightness level of the light sources. Two consecutive periods of the signal are repeated, in order to reduce transmission errors.

Figure 7B:
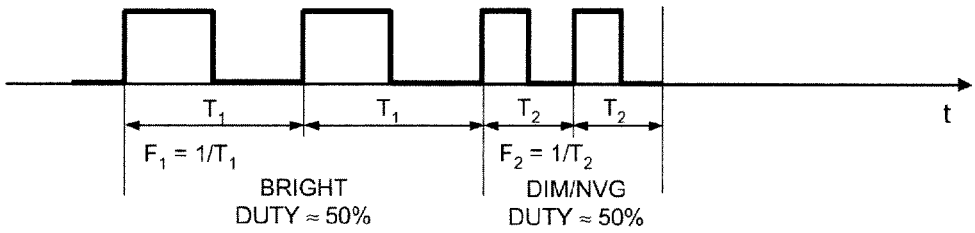

FIG. 7*b* shows an example of frequency coding of the PWM control signal, in which two values for the repetition frequency (denoted with $F_1$ and $F_2$) are used to code the lighting mode information, e.g. 200 Hz is used to code the 'BRIGHT' lighting mode, and 1000 Hz is used to code the 'DIM/NVG' lighting mode. Even in this case, duty cycle controls the brightness level.

If a greater number of lighting modes are to be coded, a higher number of different amplitude levels or frequency values may be used. For example, if it is necessary to code three different lighting modes using amplitude coding, 3.3V peak value may code the 'NVG' lighting mode, 6.6V peak value may code the 'DIM' lighting mode, and 10V peak value may code the 'BRIGHT' lighting mode. Variations of the two parameters may also be combined, giving rise to a combined amplitude and frequency coding, with the possibility of greatly increasing the number of coded lighting modes (or lighting system conditions, or any other status information). For example, using two possible amplitude levels and two possible frequency repetition values, it is possible to code four lighting modes (e.g. the 'BRIGHT', 'DIM', 'NVG' and 'TEST' modes).

The same coding scheme may be further extended using additional parameters of the PWM control signals; for example, in the case of a trapezoidal waveform signal, different slope values could be used (and even combined with the amplitude and frequency values) to code management information concerning the lighting system. Advantageously, the number of available waveform parameters will increase with the increase of complexity of the PWM control signal waveform.

In general terms, if $N_1$ is the number of discrete levels available for parameter 1, $N_2$ is the number of discrete levels available for parameter 2, and NM is the number of discrete levels available for parameter M, it will be possible to code a total number of status equal to: $N_1 \cdot N_2 \cdot \ldots \cdot N_N$.

The use of the proposed "simple coding scheme" thus allows to greatly reduce the wiring complexity of the lighting system 1', by avoiding the discrete control signals transmitted from the DMCU 3 to the equipments 4; in particular, it is possible to save at least a discrete control signal for each equipment 4 (in the simple case envisaging the presence of only two lighting modes and only one light source type in each equipment 4), so saving a minimum of W wiring connections, where W is the number of equipments 4 receiving the PWM control signal thus coded.

Each interface unit 9 receiving the coded PWM control signal will be properly configured so as to be able to decode all the information associated thereto. Complexity of the decoding circuit in the interface units 9 will increase with the coding complexity, and with the number of coded status.

The simple coding scheme is suitable to solve a typical maintainability problem of the lighting system. In order to harmonize light in the cockpit (as required with low level of brightness, for example in NVG mode) and to have cockpit brightness level into a specific range, it may be necessary to increase (or decrease) the brightness of some light sources 5 with respect to the others; also, it may be required to optimize brightness due to one or more light sources having an exposed position (e.g. glare-shield) or non-exposed position (e.g. overhead). These issues define a requirement at the system level, normally known as "trimming capability".

Since both current and duty cycle values may be used to define the level of light emitted by the LEDs, a first solution envisages coding the current value by the same waveform parameter used to define the lighting mode. For example, considering the amplitude coding shown in FIG. 7*a*, the current value may be coded as follows:

A1+20%=12V: high current level in BRIGHT lighting mode (e.g. 13 mA);

A1=10V: medium current level in BRIGHT lighting mode (e.g. 10 mA);

A1−20%=8V: low current level in BRIGHT lighting mode (e.g. 8 mA);

A2+20%=6V: high current level in DIM/NVG lighting mode (e.g. 2.5 mA);

A2=5V: medium current level in DIM/NVG lighting mode (e.g. 2 mA); and

A2−20%=4V: low current level in DIM/NVG mode (e.g. 1.5 mA).

According to an alternative solution, modulation of a further waveform parameter, different from those used to code the lighting mode and duty cycle information, is used to code the light source current level. For example, the frequency coding scheme shown in FIG. 7*b* may be modified by adding an amplitude modulation to code the current level (to achieve the above trimming capability); three different amplitude levels may be used to code three different current levels for the LED current drivers. Analogously, in the amplitude coding scheme of FIG. 7*a*, different frequency values may code the current level information. Clearly, any set-up parameter may be coded in the above manner, i.e. with the modulation of the further waveform parameter.

Even if not shown in detail, every possible combination of the PWM waveform parameters (duty cycle, frequency, amplitude, and even additional parameters in case of complex waveforms) may be used to code and transfer the information necessary for the management of the lighting system. Table 1 shows all possible parameter combinations, in the event that amplitude, frequency and duty cycle waveform parameters are used:

TABLE 1

| Coded information | Waveform Parameters | | | | | |
|---|---|---|---|---|---|---|
| | Comb 1 | Comb 2 | Comb 3 | Comb 4 | Comb 5 | Comb 6 |
| Brightness | Amp. | Freq. | Duty | Duty | Amp. | Freq. |
| Lighting Mode | Duty | Duty | Amp. | Freq. | Freq. | Amp. |
| Current value | Freq. | Amp. | Freq. | Amp. | Duty | Duty |

Combinations 3 and 4 have been shown in FIGS. 7*a* and 7*b*, respectively, and are currently the preferred solutions for the complex coding scheme. In fact, it is more convenient to code the brightness information with the duty cycle, having values in the range from 0% to 100% variable with high resolution, and to code lighting mode and current value, having discrete values, by the amplitude and frequency parameters. The use of frequency to code brightness in combinations 2 and 6 may lead to EMC problems, due to the fact that large frequency variations are required to code all possible brightness values.

A further embodiment of the present invention will now be described, referred to as the "PWM complex coding", which allows to achieve a even higher reduction of the wiring complexity and of the overall weight of the lighting system, by further increasing the information content associated to the PWM control signals.

Figure 8:
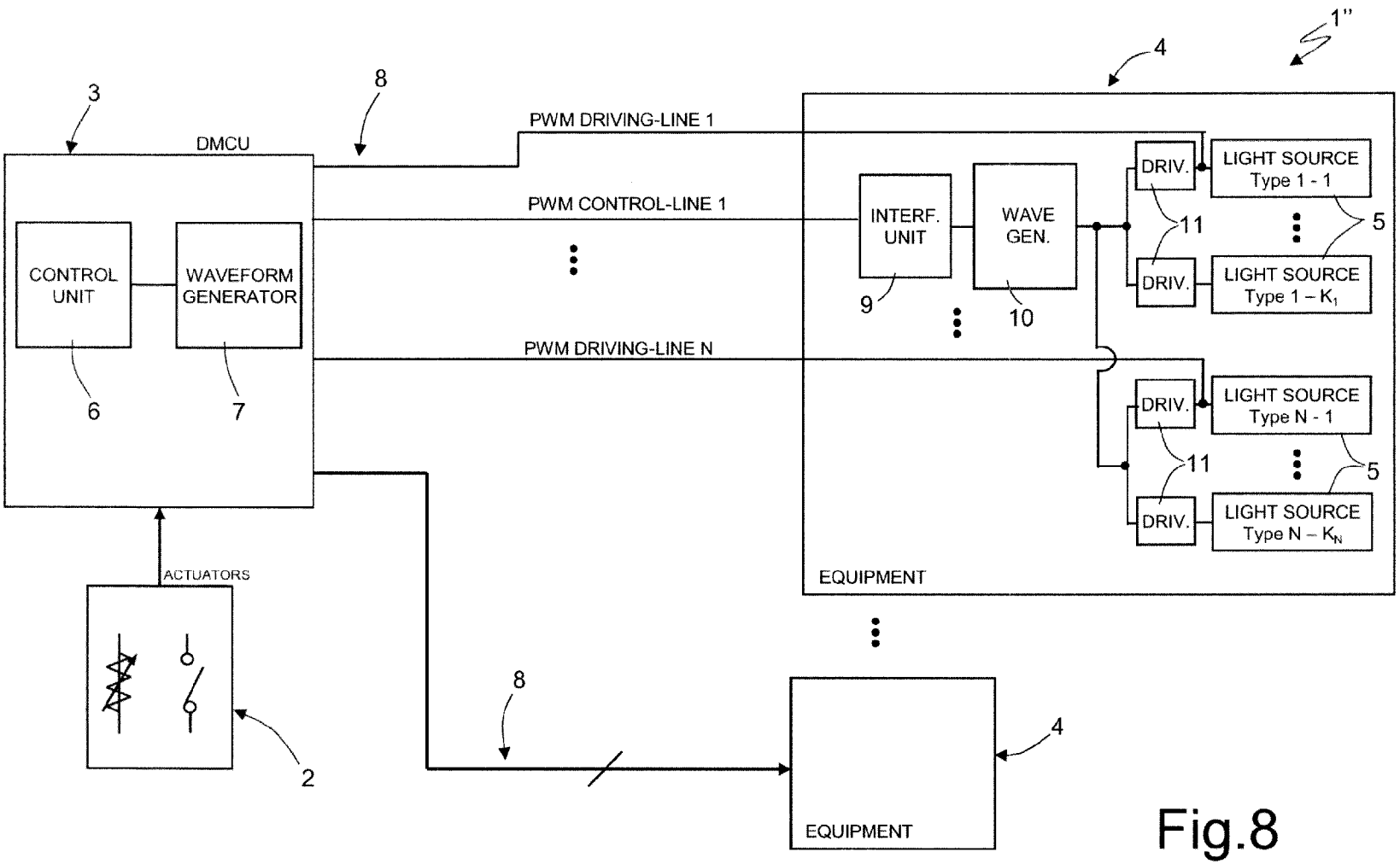
FIG. 8 shows a schematic block diagram of a lighting system for avionics application, according to a further embodiment of the present invention.

The idea underlying this embodiment is that of introducing a dedicated communication protocol for the transmission of the PWM control signals from the DMCU 3 to the equipments 4. In particular, as it will be described in detail, use of the communication protocol will allow to reduce the number of PWM control signals (and associated signal lines) to be communicated to each equipment 4 to just one PWM control signal, instead of having one PWM control signal and one signal line for each interface unit 9 within each of the equipments 4; the lighting system according to this embodiment, denoted with 1", is shown in FIG. 8, and corresponds to the lighting system 1 of FIG. 2, except for the presence of just one PWM control signal and associated signal line for each equipment 4; also, only one interface unit 9 is used in each of the equipments 4.

In particular, the proposed solution envisages the use of two fields in the PWM control signal transmitting management information for the lighting system 1": a first field being a "Line Address Field" used as a "Control Word" to code the "address" of a light source (i.e. the light source type); and a second field being an "Instruction Field" used to code the necessary lighting parameters (such as lighting mode and brightness level). The lighting parameters are coded in the "Instruction Field" substantially in the same way described previously; the light source address is coded in the "Line Address Field" using again one or more of the waveform parameters of the PWM control signal (amplitude, duty cycle, frequency or other parameters).

In detail, a first waveform parameter is used to code the field (i.e. to indicate the presence of a "Line Address Field" or an "Instruction Field"). Within the "Instruction Field" a second, different, waveform parameter is used to code the lighting mode, and a third waveform parameter, different from the previous two, is used to code the brightness information. Within the "Line Address Field", one of the second or third waveform parameters is also used to code the address (or type) of the light sources, that are to be driven with the selected operating values. Accordingly, the information content associated to the waveform parameters depends on the field of the PWM control signal.

Figure 9A:
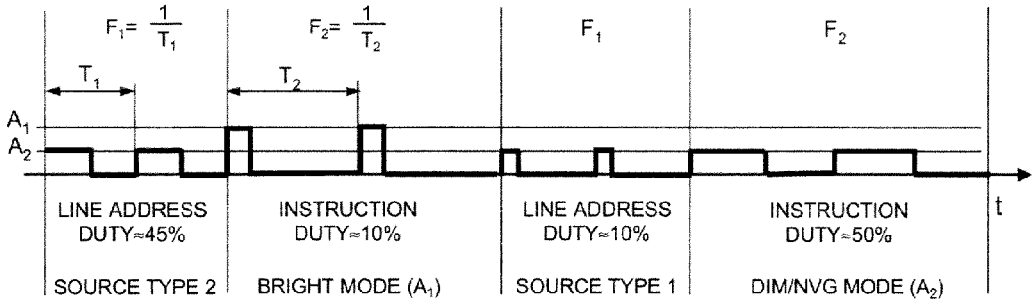
FIGS. 9*a*-9*c* show possible variants of a "complex coding" scheme in the lighting system of FIG. 8.

A first example of the above complex coding scheme is shown in FIG. 9*a*. Two possible frequency values $F_1$ and $F_2$ are used to code the field information in the PWM control signal, the value $F_1$ being associated to the "Line Address Field", and the value $F_2$ being associated to the "Instruction Field". In the "Line Address Field", duty cycle of the PWM control signal is indicative of the address of the light source, or light source type. For example, if eight light source types are present in the equipment 4 that is receiving the PWM control signal, the following rule may be used to code the address information:

light source type 1: duty cycle from 3% to 13%;
light source type 2: duty cycle from 15% to 25%;
light source type 3: duty cycle from 27% to 37%;
light source type 4: duty cycle from 39% to 49%;
light source type 5: duty cycle from 51% to 61%;
light source type 6: duty cycle from 63% to 73%;
light source type 7: duty cycle from 75% to 85%; and
light source type 8: duty cycle from 87% to 97%.

Values of the duty cycle less than 2% and greater than 98% are not used, so that it is possible to recognize failures on the PWM control line, for example a wiring disconnection, or the PWM control signal being stuck to the voltage supply value.

After transmitting the information about the light source type (two identical periods are repeated in each field, in order to avoid errors), PWM waveform at frequency $F_2$ is used to code the "Instruction Field", containing information about the brightness (coded through the duty cycle value) and the lighting mode (coded through amplitude coding, i.e. by means of different amplitude levels, as previously described); again, two consecutive periods are repeated (this repetition being advantageous to reduce the probability of errors; repetition may also not be implemented, or implemented for a greater number of times). In the example, amplitude $A_1$ (e.g. equal to 10V) codes a 'BRIGHT' mode, and amplitude $A_2$ (e.g. equal to 5V) codes a 'NVG/DIM' mode (in general, increasing the number of amplitude steps allows increasing the coded lighting modes).

Considering a value of 400 Hz for $F_1$ and a value of 800 Hz for $F_2$, with two pulse repetitions for each light source type and a total of eight light source types, about 60 ms will be necessary for transferring (from the DMCU 3 to the equipment 4) complete information for management of all the light source types in the equipment 4. Frequency values may be increased in order to decrease transfer time.

Figure 9B:
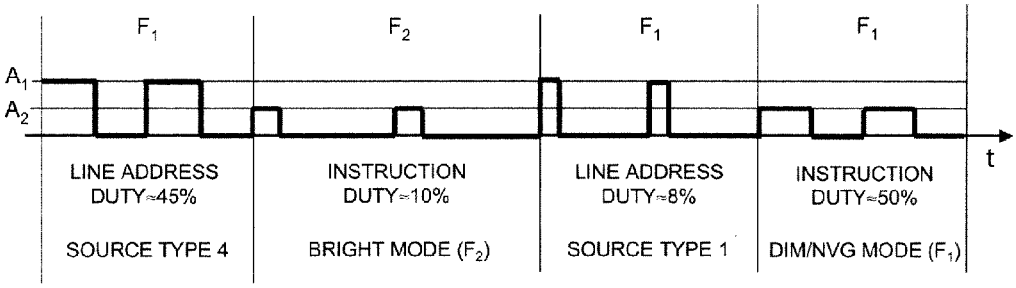

A second example of the above complex coding scheme is shown in FIG. 9*b*. In this case, the light source type is coded by the duty cycle of the waveform of the PWM control signal having a first amplitude level $A_1$ (the first amplitude level $A_1$ being associated to the "Line Address Field"); while the brightness level and the lighting mode are coded by the duty cycle and, respectively, the repetition frequency of the waveform having a second amplitude level $A_2$ (the second amplitude level $A_2$ being associated to the "Instruction Field"). In particular, lighting mode is coded through frequency coding, frequency $F_1$ coding the 'NVG/DIM' mode, and frequency $F_2$ the 'BRIGHT' mode.

Even if not shown in detail, every possible combination of the PWM waveform parameters (duty cycle, frequency, amplitude, and even additional parameters in case of complex waveforms) may be used to code and transfer the information necessary for the management of the lighting system, as shown in Table 2:

TABLE 2

| Coded | Waveform Parameters | | | | | |
|---|---|---|---|---|---|---|
| information | Comb 1 | Comb 2 | Comb 3 | Comb 4 | Comb 5 | Comb 6 |
| Field | Freq. | Amp. | Duty | Duty | Amp. | Freq. |
| Brightness | Duty | Duty | Amp. | Freq. | Freq. | Amp. |
| Lighting Mode | Amp. | Freq. | Freq. | Amp. | Duty | Duty |

Combinations 1 and 2 have been shown in FIGS. 9*a* and 9*b*, respectively, and are currently the preferred solutions for the complex coding scheme.

Figure 9C:
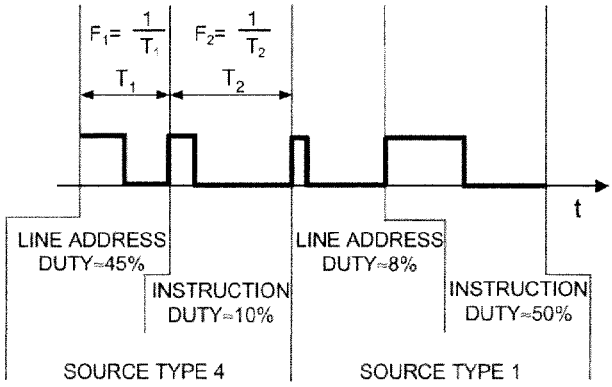

As shown in FIGS. 9*a* and 9*b*, for each field two periods of the PWM control signals may be used, in order to avoid misunderstandings and to manage fail conditions; clearly, it is possible to envisage the repetition of a higher number of periods. On the contrary, as shown in FIG. 9*c* (that refers to combination 1 of Table 1 and corresponds to previous FIG. 9*a*), if communication speed is a critical parameter, it is possible to use only one repetition period for each field. In this case, the time necessary to transfer the information from the DMCU 3 to each equipment 4 is reduced to about 30 ms.

The described complex coding solution and associated communication protocol advantageously allows to transfer all the information necessary to manage the lighting system 1' using just one single control line for each of the equipments 4. In fact, complete information necessary to manage all the light sources 5 inside the equipment 4 is associated to a single PWM control signal. The advantage in terms of wiring complexity is evident, since the number of connections in the lighting system is dramatically reduced. Considering a complex lighting system (such as one for a cargo aircraft), use of the simple coding scheme can reduce the number of connections in the cockpit up to 100-200 (without any discrete control line); supposing 4-5 light source types in each equipment, use of the complex coding scheme allows to further reduce the number of connections up to about 30 connections (i.e. one connection for each equipment 4, if it is supposed that PWM driving signals are not transmitted from the DMCU 3 to the equipments 4). Obviously, the reduction in the number of connections is accompanied to an increased complexity of the decoding circuit in the interface unit 9 of each equipment 4, that shall be able to decode the complex coding scheme having the knowledge of the communication protocol used to transmit the information; use of complex logic devices, such as an FPGA or even a microprocessor, could thus be required also at the equipment level (and not only at the DMCU level).

As previously discussed in connection with the simple coding scheme, trimming capability may also be provided by the introduction of a further modulation on the "Line Address Field", coding current values of the controlled light sources. For example, in the example of FIG. 9*a*, amplitude modulation in the Line Address Field may be envisaged to define different current values; in particular, three different amplitude levels may be used to define three different current levels, as already discussed for the simple coding scheme. According to this solution, current of each light source can be trimmed according, for example, to light homogeneity requirements.

A further embodiment of the present invention envisages a further evolution of the coding scheme and protocol used to exchange information, and provides a bidirectional communication between the DMCU 3 and the various equipments 4 in the cockpit, during test or maintenance operations of the lighting system.

Figure 10:
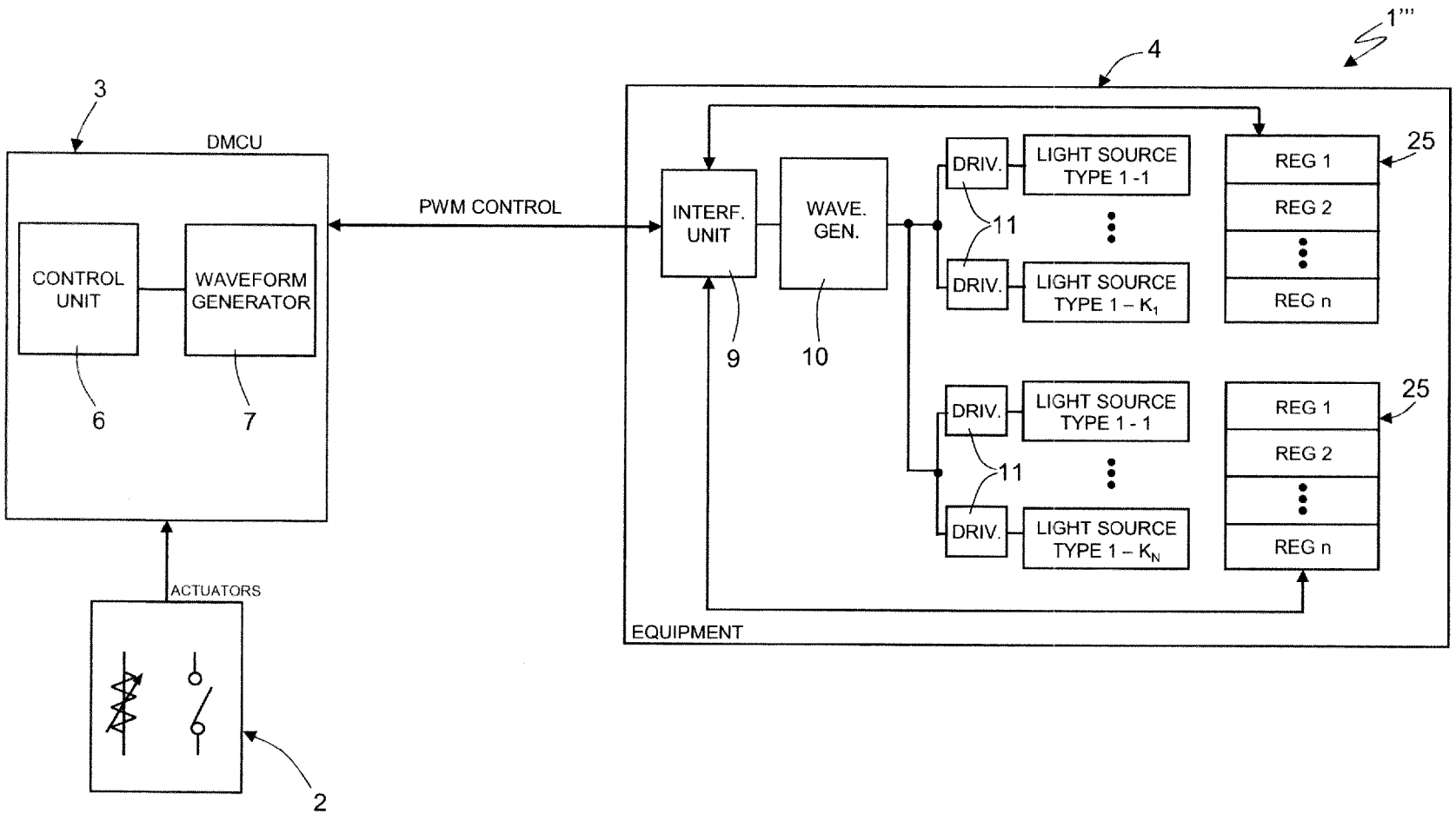
FIG. 10 shows a schematic block diagram of a lighting system for avionics application, according to a further embodiment of the present invention.

As shown in FIG. 10 (which depicts, for sake of simplicity, a single equipment 4 in the lighting system, here denoted with 1''', and omits PWM driving signals), a number of registers 25 (or other suitable storage elements) for storing maintenance information (e.g. information about the condition of the light sources, and configuration information) is provided for each type of light sources 5. According to the proposed solution, DMCU 3 is considered as a MASTER unit, while the various equipments 4 are considered as SLAVE units (that are driven by the MASTER unit and receive lighting system information therefrom). Bidirectional communication allows to code READ and WRITE commands from MASTER to SLAVE units by the use of the PWM waveform parameters (amplitude, duty cycle, frequency and/or further parameters).

In particular, bidirectional communication allows the DMCU 3 to read information stored in the registers 25 (e.g. to read an operating status or condition of the corresponding light sources 5), in order to provide a self-test functionality, or to write configuration information in the same registers 25 (e.g. to properly configure the corresponding light sources 5, to adapt to variations in the equipment arrangement). For example, a READ operation can be used to read information about the presence of a failure at a given light source 5, by reading the content of a register dedicated to the operational status of the light source; in the case of configurable light sources having different control-to-output transfer curves, the READ operation can be used to obtain information about the light source transfer curve; in general, any type of configuration register associated to any given light source or light source type can be read. A WRITE command can be used to change and define the current value supplied by drivers associated to the light source, providing a trimming capability in the cockpit; to define a fail lighting level (e.g. a dedicated lighting level showing problems with PWM control or loss of electrical connection); to change the light source transfer curves (as explained above).

The bidirectional communication scheme will be described in detail as an evolution of the complex coding scheme, introducing simultaneous amplitude and frequency coding in the "Line Address Field" of the PWM control signal, in order to transmit further information (in particular read or write information). However, it shall be understood that, although described in connection with the complex coding scheme, the proposed bidirectional communication can be associated to any kind of coding scheme for transmission of the lighting information (brightness, lighting mode and light source type) to the various equipments 4, or even to no coding scheme at all (in the latter case, the PWM control signal carrying only a brightness level information by its duty cycle). Indeed, the protocol for bidirectional communication is not influenced by, and does not influence, the manner in which lighting information are exchanged (e.g. whether they are exchanged with the same PWM control signal or through the PWM control signal and additional discrete control signals). Furthermore, the bidirectional communication for maintenance of the lighting system may even be implemented with a dedicated communication line, separate and distinct from the signal line 8 through which signals controlling the light and brightness emitted by the lighting system are exchanged.

In detail, it is proposed to use the "Line Address Field" in the PWM control signal both as a "Control Word" to code the address (or type) of a light source (as described for the complex coding scheme), and as a "Command Word" to code a "READ" or "WRITE" command to be executed during the bidirectional communication. If amplitude modulation is used to define the presence of a "Line Address Field" or "Instruction Field", then a combined frequency modulation is used to define a control or command word; on the contrary, if frequency modulation is used to define the presence of a "Line Address Field" or "Instruction Field", then a combined amplitude modulation is used to define a control or command word. In any case, contemporary amplitude and frequency modulation is present in the "Line Address Field". Clearly, other possible combined parameter variations can be envisaged, the above two possibilities being the more advantageous for the reasons already discussed for the complex coding scheme.

To the "Instruction Field", following the "Line Address Field", are associated different management information for the lighting system depending on the use of the "Line Address Field" as a control or command word. In particular, if the "Line Address Field" is used as a control word, then the "Instruction Field" is used with the same coding rules previously described (e.g. with the duty cycle defining the brightness level, and one parameter between the amplitude and frequency defining the lighting mode); if instead the "Line Address Field" is used as a command word, then the "Instruction Field" is used to code a READ or a WRITE command and also to specify the register to be read or written.

Figure 11:
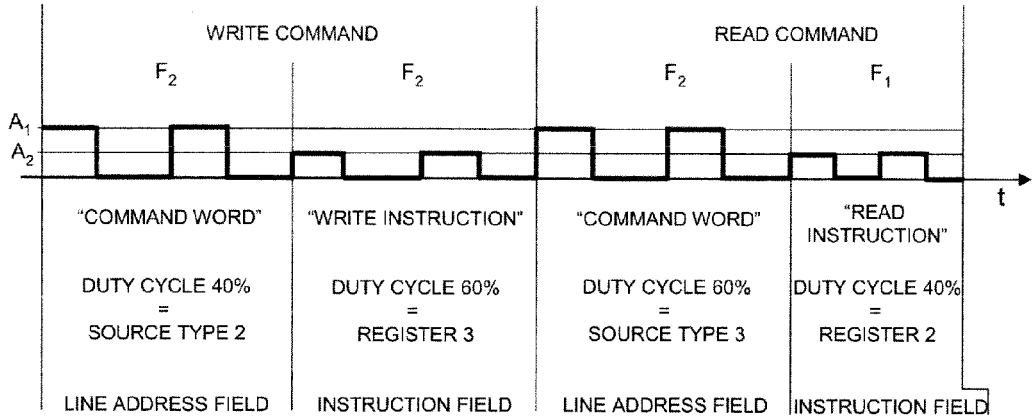
FIGS. 11-12 show possible variants of a "bidirectional communication" scheme implemented in the lighting system of FIG. 10.

Based on combination 1 of the complex coding scheme, FIG. 11 shows a possible implementation of a bidirectional communication; only the portion of the signal relating to the bidirectional communication is indeed shown, while the portion related to the exchange of lighting information (altogether similar to what previously shown and described) is not shown again.

In detail, amplitude level $A_1$ codes the "Line Address Field": within the "Line Address Field", frequency $F_1$ defines a Control Word (here not shown), while frequency $F_2$ defines a Command Word, used to implement the bidirectional communication, with the duty cycle being used to define the light source address (the same as for control word). Amplitude level $A_2$ codes the "Instruction Field": if after a control word (here not shown), same rules apply as defined with complex coding scheme, so that duty cycle fixes the brightness level and frequency fixes the lighting mode; after a command word (as shown in FIG. 11), frequency $F_1$ denotes a READ command and frequency $F_2$ a WRITE command, and the duty cycle of the PWM control signal is used to define the register to be read or written.

Table 3 defines an exemplary correspondence between duty cycle and light source type or register number:

TABLE 3

| Duty Cycle | Source Type | Register Number |
|---|---|---|
| 4% to 24% | type 1 | n° 1 |
| 28% to 45% | type 2 | n° 2 |
| 52% to 72% | type 3 | n° 3 |
| 76% to 96% | type 4 | n° 4 |

With this exemplary coding, each source type can have up to four registers associated thereto.

Figure 12:
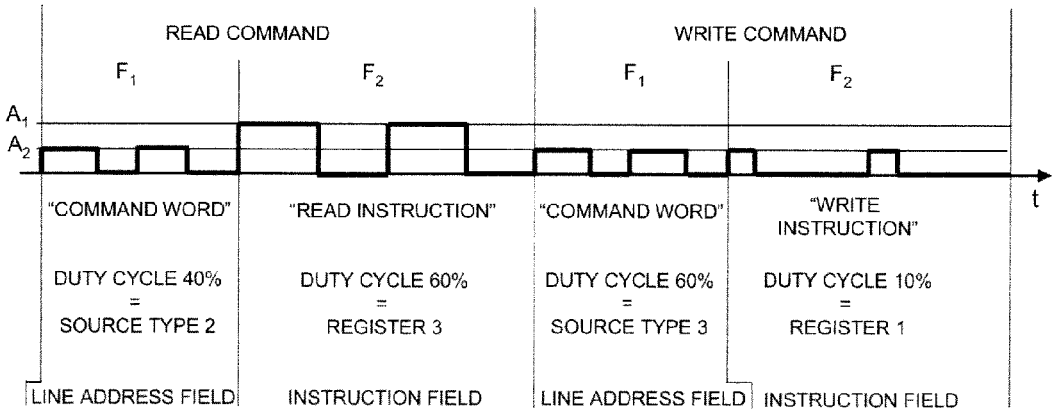

FIG. 12 shows another possible implementation of the bidirectional scheme, based on combination 2 of the complex coding scheme.

Here, frequency $F_1$ codes the "Line Address Field": within the "Line Address Field", amplitude $A_1$ defines a Control Word (here not shown), while amplitude $A_2$ defines a Command Word, used to implement the bidirectional communication, with the duty cycle being used to define the light source type. Frequency $F_2$ codes the "Instruction Field": in particular, after a command word, amplitude $A_1$ denotes a READ command and amplitude $A_2$ a WRITE command, the duty cycle of the PWM control signal being used to define the register to be read/written.

A dedicated communication protocol is implemented to define the timing of the reading and writing operations, so that the information content associated with the PWM control signal can be correctly interpreted; in particular, during WRITE and READ operations, control of the lighting system 1''' (in terms of light parameters) is put in stand-by, with lighting mode and brightness fixed to the previously selected values. Thus, the bidirectional communication protocol may be used during a maintenance mode, when lighting system brightness management and communication speed are not required.

Figure 13:
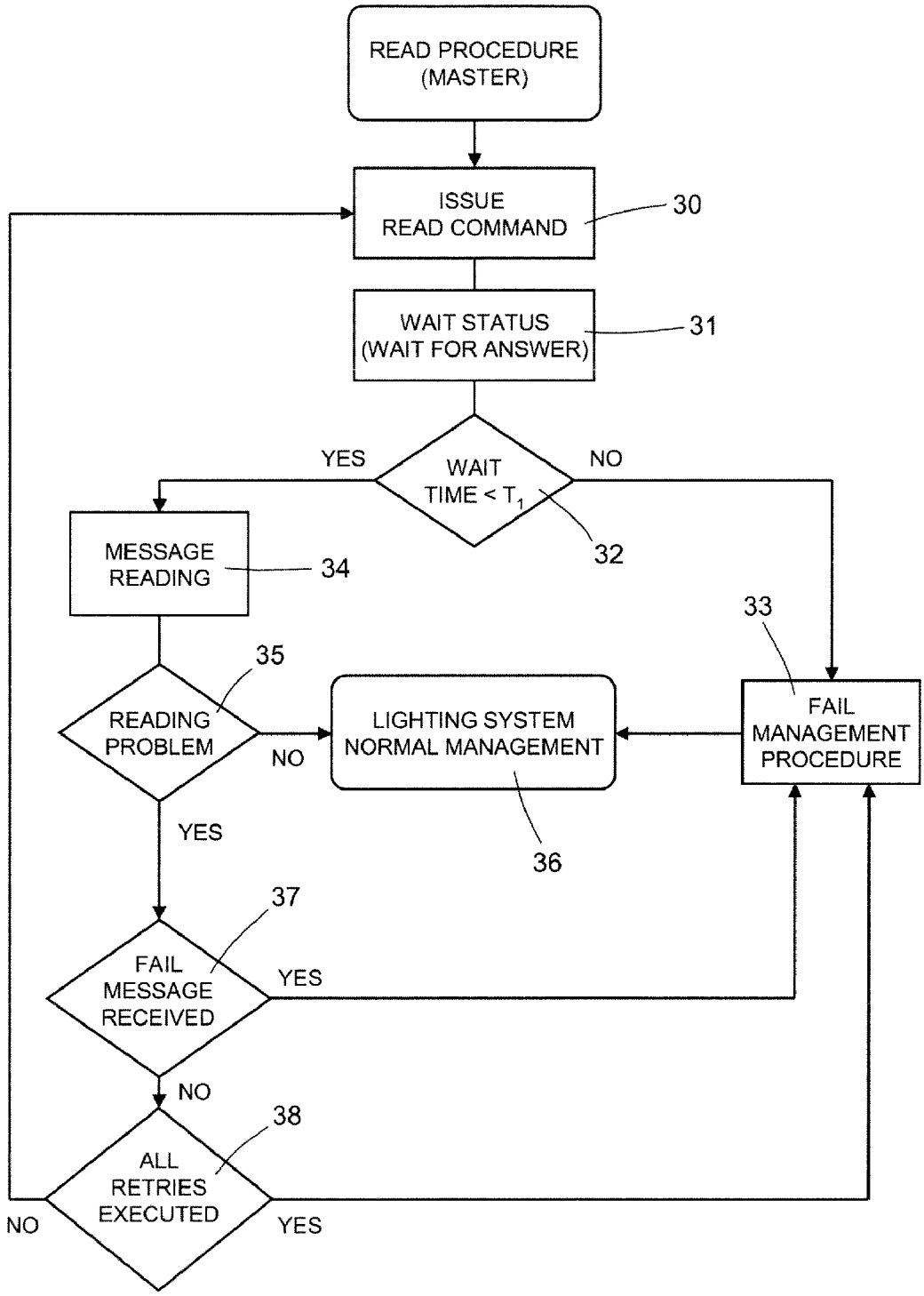
FIG. 13 is a flow diagram of a read procedure implemented by a dimming control unit of the lighting system of FIG. 10.

As shown in FIG. 13, the READ procedure, at the DMCU (or master) side, may envisage the issue of a read command (by properly coding the PWM control signal, as previously explained) at block 30. Next, the DMCU 3 waits for an answer from the interrogated equipment 4 (slave unit) at block 31. If no answer is received within a given period $T_1$, no exit from block 32, a fail management procedure is initiated by the DMCU 3 at block 33. If instead an answer message is received during the given period, yes exit from block 32, the DMCU 3 reads the message at block 34 (verify operation). If no reading problem is encountered, no exit from block 35, procedure then returns to a normal management of the lighting system at block 36 (e.g. lighting information are again exchanged between the DMCU 3 and the interrogated equipments 4); on the contrary, if any reading problem is encountered, yes exit from block 35, the DMCU 3 checks whether a fail message has been received (indicative of a reading failure) at block 37. If this message has been received, yes exit from block 37, procedure returns to block 33 for the fail management procedure; otherwise, DMCU 3 checks if a given number of retries of the reading procedure has already been executed at block 38, and either the fail management procedure is again initiated (yes exit from block 38), or the READ procedure is retried (no exit from block 38) so that procedure starts again from block 30 (where a new READ command is issued to the selected equipment).

Figure 14:
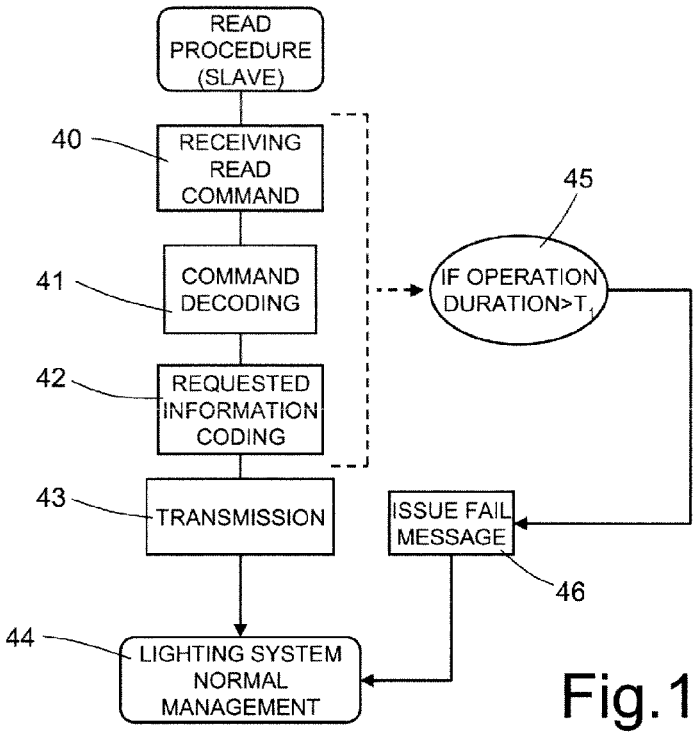
FIG. 14 is a flow diagram of a read procedure implemented by an equipment of the lighting system of FIG. 10.

As shown in FIG. 14, the reading protocol at the equipment (or slave) side, may envisage first the receipt of the read command from the DMCU 3 at block 40. Then, block 41, the received command is decoded at block 41, and the requested information (read from the addressed register 25) is coded, block 42, and then transmitted to the DMCU 3, block 43, again as a PWM control signal (internally generated in the equipment 4). Subsequently, the procedure returns to a normal management of the lighting system at block 44. If during any of the above steps, the envisaged operation requires a period that is greater than the given period $T_1$, as checked in block 45, a fail message is transmitted to the DMCU 3 at block 46, and procedure returns to block 44.

Figure 15A:
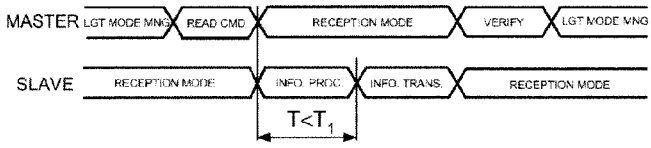
FIGS. 15*a*-15*c* show timing diagrams relating to the read procedure of FIGS. 13 and 14.
Figure 15B:
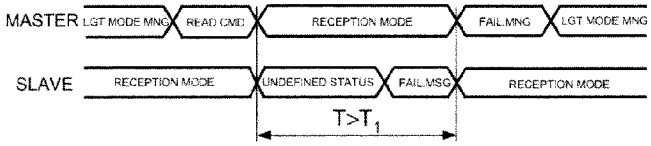
Figure 15C:
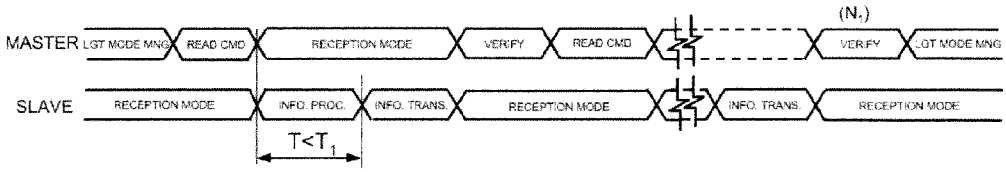

Exemplary timings for the reading procedure, at the master and slave sides, are shown in FIGS. 15*a*-15*c*, that relate to a normal read operation, to the absence of an answer from the equipment 4 following a read command, and to a problem occurring in the reading operation (the problem being resolved in retry $N_1$), respectively. 'LGT' stands for Lighting, 'INFO' for Information, 'PROC' for Processing, 'TRANS' for Transmission, 'MNG' for Management, and 'MSG' for message.

The answer transmitted by the interrogated equipment 4 to the DMCU 3 is a PWM control signal exchanged via the control signal line, having a structure based on rules similar to those explained above for coding the READ command.

Figure 16A:
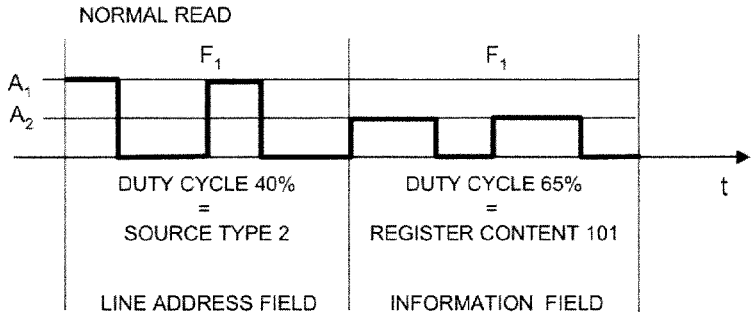
FIGS. 16*a*-16*b* show read signals exchanged during the read procedure, in case of a normal read and a failure, respectively.
Figure 16B:
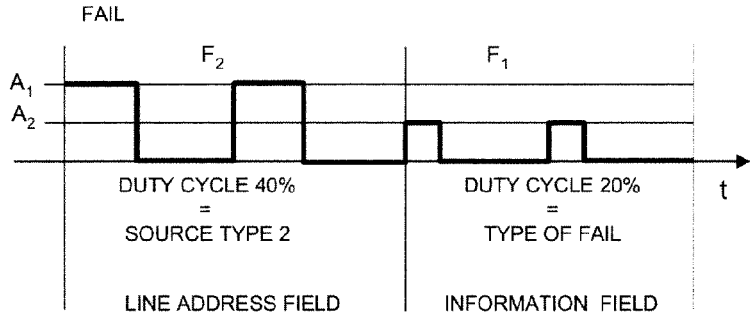

FIGS. 16*a* and 16*b* (relating to a normal read, and to a read with failure, respectively) show a possible coding scheme, wherein the amplitude parameter is used to denote the "Line Address Field" or "Instruction Field" (combination 1 previously described).

In detail, amplitude $A_1$ is used to code the "Line Address Field": frequency $F_1$ is used to define a normal read (with the duty cycle specifying the light source address), while frequency $F_2$ defines a FAIL condition in reading (with the duty cycle communicating to the DMCU 3 the light source address where the failure occurred).

Amplitude $A_2$ defines an "Information Field", that is used to communicate the requested information. In the event of a normal read operation (FIG. 16*a*), duty cycle of the PWM waveform codes the read register content, as discussed below; the frequency value may not contain any information and be fixed without any specific rule, or alternatively may be used to code the register address (as previously explained). For example, the binary content of a three-bit register can be coded by eight duty cycle steps:

000: duty cycle from 3% to 13%;
001: duty cycle from 15% to 25%;
010: duty cycle from 27% to 37%;
011: duty cycle from 39% to 49%;
100: duty cycle from 51% to 61%;
101: duty cycle from 63% to 73%;
110: duty cycle from 75% to 85%; and
111: duty cycle from 87% to 97%.

In the event of a failed read operation, the duty cycle may be used to define a failure code. For example, the failure "not decoded light source address on the read command" may be coded by a duty cycle value less than 50%, while a duty cycle higher than 50% may code the failure "reading impossible on the requested register".

Figure 17A:
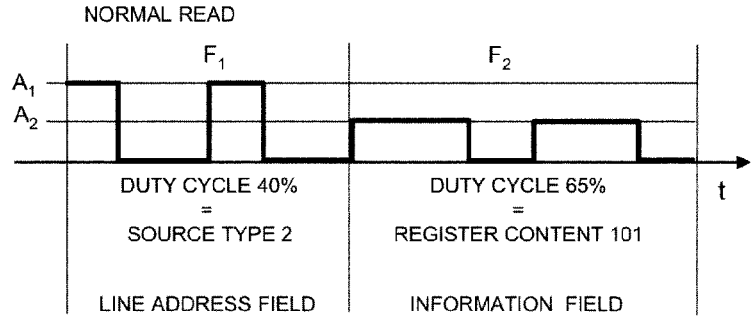
FIGS. 17*a*-17*b* show a variant of the read signals of FIGS. 16*a*-16*b;*
Figure 17B:
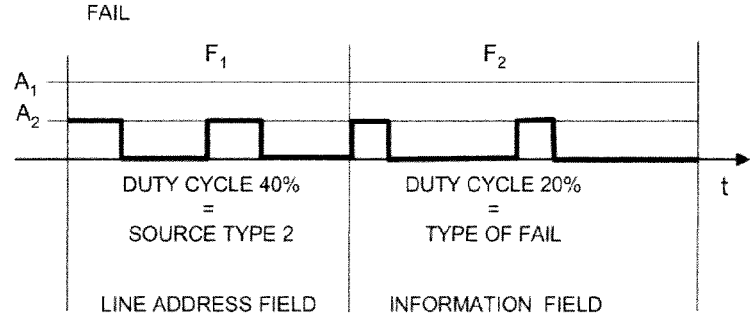

As shown in FIGS. 17*a* and 17*b* (relating again to a normal read, and a read with failure, respectively), a different coding scheme may be envisaged using the frequency parameter to denote the "Line Address Field" or "Instruction Field" (combination 2 previously described).

In detail, frequency $F_1$ codes the "Line address field". Amplitude $A_1$ defines the Command Word and duty cycle is used to notify the light source address; amplitude $A_2$ defines a FAIL condition and duty cycle is used to communicate the address of the light source where the failure occurred. Frequency $F_2$ codes the "Information Field"; as discussed above, for a normal read operation (FIG. 17*a*), duty cycle of the PWM waveform notifies the read register content; for a failed read operation (FIG. 17*b*), duty cycle defines the failure code.

The protocol for managing the WRITE procedure in the lighting system is now described.

Figure 18:
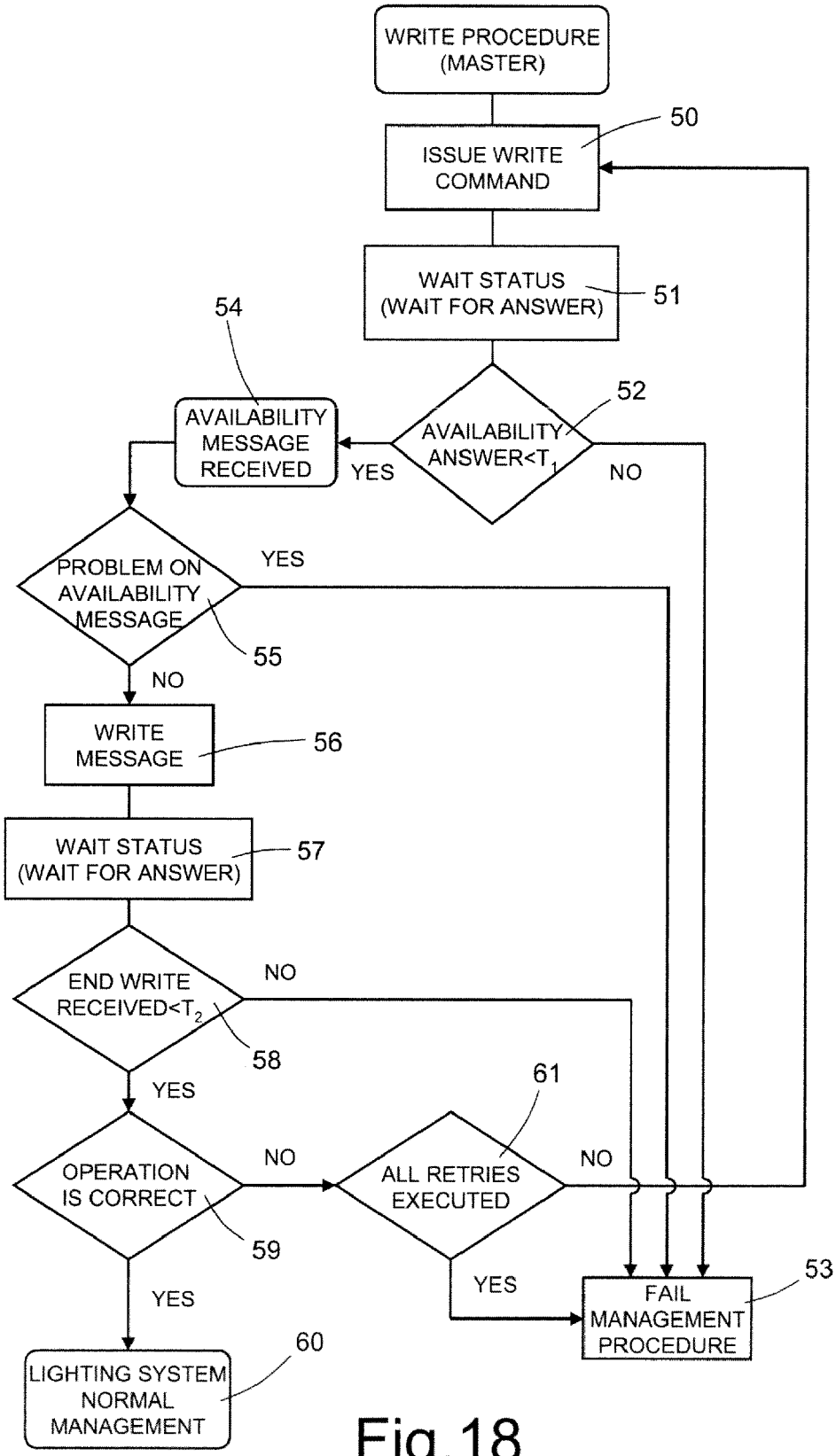
FIG. 18 is a flow diagram of a write procedure implemented by a dimming control unit of the lighting system of FIG. 10.

As shown in FIG. 18, the WRITE procedure, at the DMCU (or master) side, envisages the issue of a WRITE command from the DMCU 3 to a selected equipment 4 at block 50. The DMCU 3 then waits for an answer from the interrogated equipment 4 at block 51: if an availability answer is not received within a first period $T_1$, no exit from block 52, then a fail management procedure is initiated at block 53; otherwise, yes exit from block 52, the availability message is evaluated at block 54. If a problem exists on the availability message, yes exit from block 55, the fail management procedure is again initiated at block 53; otherwise, no exit from block 55, a WRITE message (concerning details of the WRITE command) is communicated to the equipment 4 at block 56, and the DMCU 3 again waits for an answer, block 57. If an END OF WRITE answer message (indicative of the completion of the write procedure at the slave side) is not received within a second period $T_2$, no exit from block 58, then the fail management procedure is again initiated at block 53; on the contrary, if the END OF WRITE answer message is received within the second period $T_2$, yes exit from block 58, the DMCU 3 checks the correctness of the executed operation at block 59. If the WRITE operation is deemed to be correct, yes exit from block 59, the protocol returns to the lighting system normal management at block 60; otherwise, no exit from block 59, DMCU 3 checks if a given number of retries of the WRITE procedure has already been executed at block 61, and either the fail management procedure is again initiated (yes exit from block 61), or the WRITE procedure is retried (no exit from block 61) so that procedure starts again from block 50 (where a new WRITE command is issued to the selected equipment 4).

Figure 19:
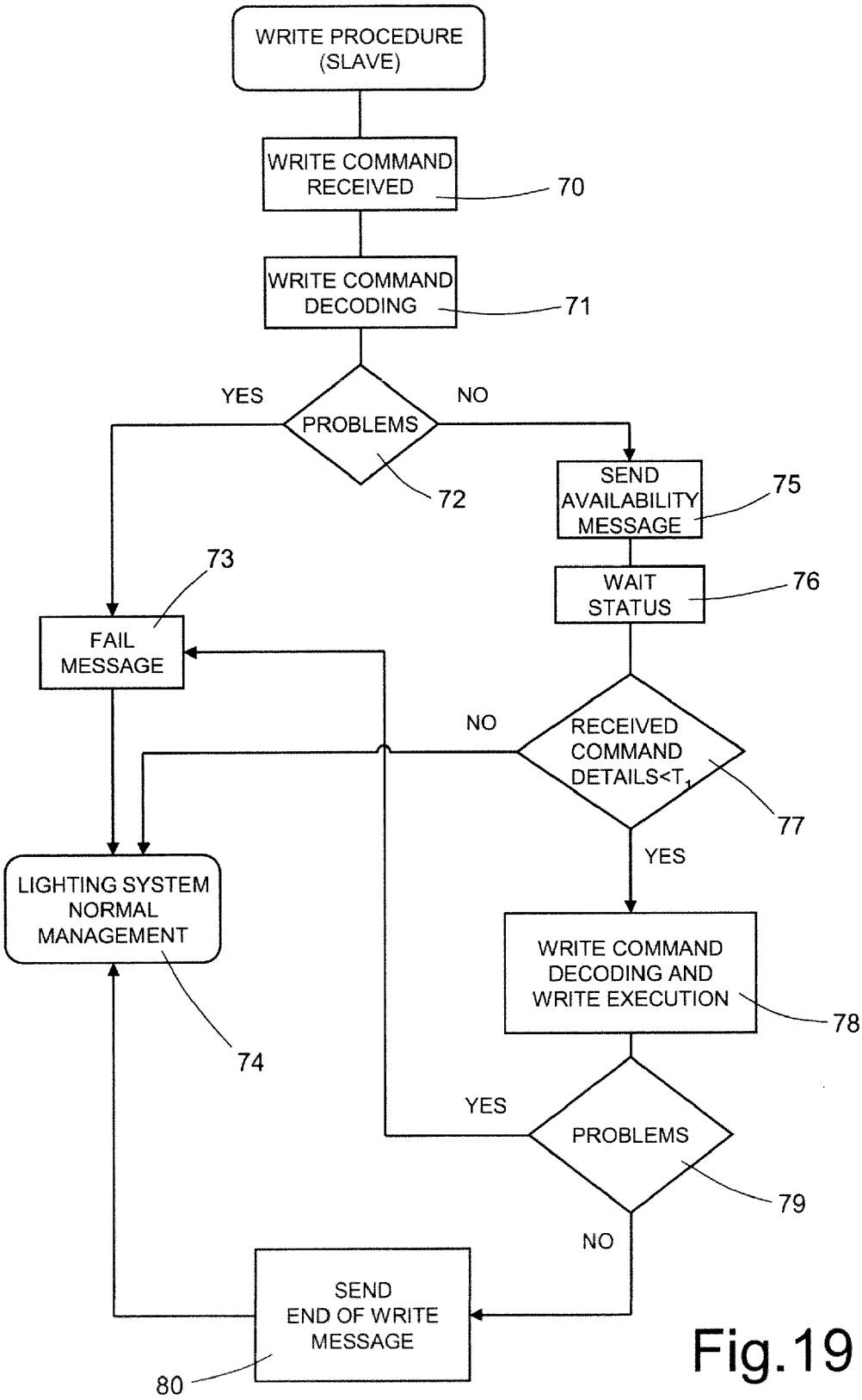
FIG. 19 is a flow diagram of a write procedure implemented by an equipment of the lighting system of FIG. 10.

As shown in FIG. 19, the WRITE protocol at the equipment (or slave) side, envisages the receipt of the WRITE command by the equipment 4, at block 70, and the following decoding of the same WRITE command, at block 71. If any kind of problem is encountered during receipt and decoding, yes exit from block 72, a FAIL message is transmitted at block 73 and protocol returns to the lighting system normal management, at block 74. Otherwise, no exit from block 72, an AVAILABILITY message is transmitted at block 75, after which the equipment 4 enters a waiting mode, at block 76. If the WRITE message (concerning details on the information to be written) is not received within a given period $T_1$, no exit from block 77, then the protocol returns to the lighting system normal management at block 74; on the contrary, if the message is received, yes exit from block 77, the command is decoded and WRITE operation executed accordingly (at the addressed register 25), at block 78. If problems are encountered during this write operation, yes exit form block 79, procedure returns to block 73 for transmittal of the FAIL message; otherwise, the END OF WRITE message is transmitted to the DMCU 3, to confirm the correct execution of the WRITE command, at block 80, and procedure returns to block 74.

The structure of the WRITE command has been previously discussed in detail; other messages exchanged between the DMCU 3 and the interrogated equipment 4 are again PWM signals, coded using one or more of the waveform parameters.

Figure 20A:
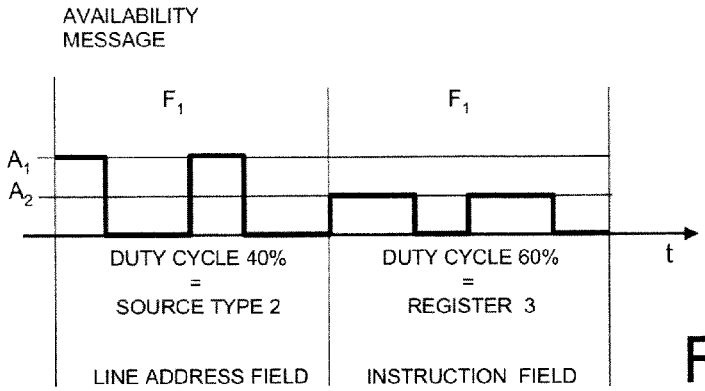
FIGS. 20*a*-20*c* show further coded signals exchanged during the write procedure.

The AVAILABILITY message may have a very simple structure, for example with fixed frequency, amplitude and duty cycle; alternatively, to the AVAILABILITY message further information may be associated, such as the light source address and register address, as confirmation information for the DMCU 3. Considering the extension of combination 1 defined above, as shown in FIG. 20*a*, in the first field (the "Line Information Field"), defined by amplitude $A_1$, duty cycle of the PWM control signal is used to confirm the light source address; in the second field (the "Instruction Field"), defined by amplitude $A_2$, the duty cycle value is used to confirm the register address. Moreover, frequency may be used to define coding operation result, frequency $F_1$ defining a correct result, and frequency $F_2$ a failure. If the extension of combination 2 is considered (here not illustrated), duty cycle at frequency $F_1$ defines the light source address, while duty cycle at frequency $F_2$ defines the register address; amplitude value may be used to define coding operation results.

The WRITE message transmitted from the DMCU 3 to the equipment 4 (after transmission of the write command word, as previously explained) may be coded according to the following rules.

Figure 20B:
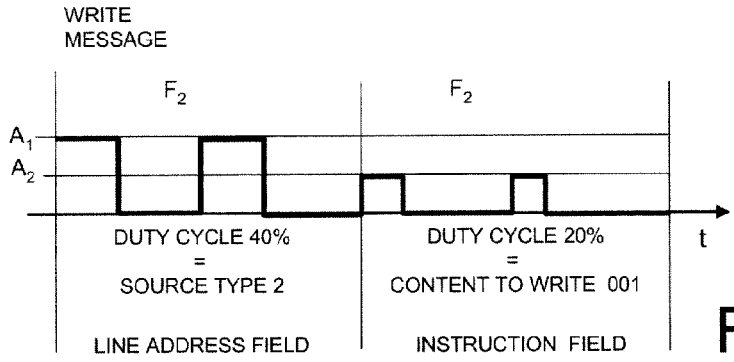

Considering extension of combination 1, as shown in FIG. 20*b*, amplitude $A_1$ codes the "Line Address Field": frequency $F_2$ defines a Command Word, with the same rules described for complex coding for addressing different light source. Amplitude $A_2$ codes the "Instruction Field" (in this case used to transmit information to be written in the equipment 4): duty cycle defines the coded information (as discussed above); frequency value does not contain information and can be fixed without any specific rule (alternatively, frequency can be used to confirm register address). If the extension of combination 2 is considered (here not shown), frequency $F_1$ codes the "Line Address Field" and amplitude $A_2$ defines the Command Word, with the same rules of complex coding used to address the different light source. Frequency $F_2$ codes the "Instruction Field" (or information field, in this case): duty cycle codes the information to be written. Also in this case, amplitude value may be fixed without any specific rule, or, as an alternative, be used to confirm the register address.

The END OF WRITE message sent by the equipment 4 to the DMCU 3 to confirm execution of the write command may be coded using the following rules.

Figure 20C:
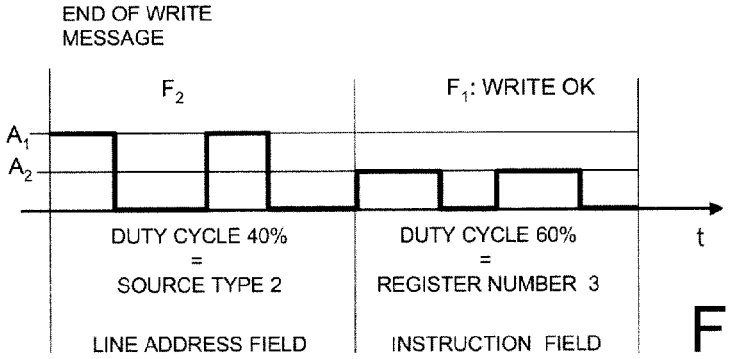

Considering extension of combination 1, as shown in FIG. 20*c*, amplitude $A_1$ is used to define the "Line Address Field" with the duty cycle value confirming the light source address; amplitude $A_2$ defines the "Instruction Field", with the duty cycle value confirming the register address and frequency value used to communicate a failure (e.g. frequency $F_1$ coding the message "Write Ok" and frequency $F_2$ the message "Operation Failed"). If the extension of combination 2 is considered (here not shown), PWM control signal at frequency $F_1$ defines the "Line Address Field" and light source address is confirmed by the duty cycle value; frequency $F_2$ defines the "Instruction Field", duty cycle value is used to confirm the register address and amplitude to communicate a failure (e.g. amplitude $A_1$ coding the message "Write Ok" and amplitude $A_2$ the message "Operation Failed").

Figure 21:
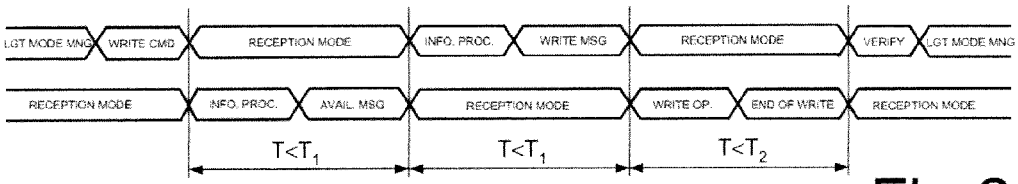
FIG. 21 shows a timing diagram relating to the write procedure.

Exemplary timings for the write procedure are shown in FIG. 21, wherein 'CMD' stands for command, 'INFO' for information, 'PROC' for processing, 'MSG' for message, 'TRANS' for transmission, 'MNG' for management, 'AVAIL' for availability, and 'OP' for operation.

Figure 22:
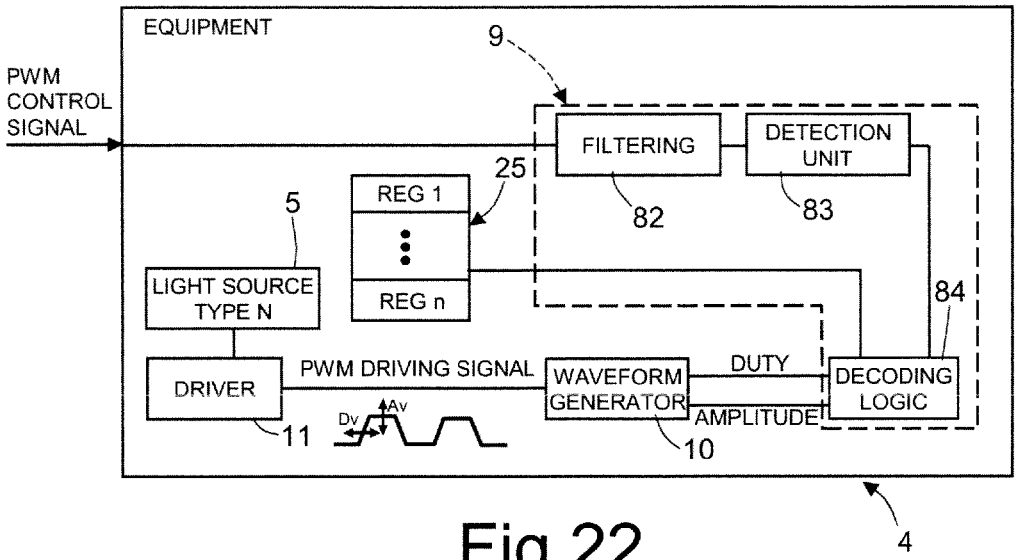
FIG. 22 shows a schematic block diagram of an equipment of the lighting system of FIG. 10.

FIG. 22 shows in more detail the internal architecture of one of the (slave) equipments 4 of the lighting system 1''', receiving at its input the PWM control signal from the DMCU 3.

Interface unit 9 within equipment 4 includes: a filtering stage 82, receiving and filtering the PWM control signal; a detection unit 83, receiving the filtered PWM control signal and extracting therefrom amplitude, frequency and duty cycle information; and a decoding logic 84, receiving and decoding (as will be discussed later) the detected amplitude, frequency and duty cycle information, so as to generate duty cycle and amplitude values to be supplied to the internal waveform generator 10 (as described with reference to FIG. 10). The internal waveform generator 10 generates a PWM driving signal with suitable duty cycle and amplitude values, for driving, via dedicated current driver 11, the light sources 5 within the equipment 4 (only one of which is shown in FIG. 22). The decoding logic 84 is also coupled to the registers 25 associated to the light source 5, for management of the read and write operations. Driver 11 includes a power amplifier, that reproduces the received waveform shape with high current capability and short circuit protection.

As not shown in detail, when bidirectional communication is to be implemented, a dedicated line may be used for transmitting data to the DMCU 3; otherwise, the same line (signal line 8) transmitting data from the DMCU 3 to the equipment 4 may be used, in this case being a bidirectional bus. In the latter case, a bidirectional bus driver (not shown) within the decoding logic 84, controls the exchange of data in reception or transmission: data to be transmitted from the equipment 4 to the DMCU 3 are coded via PWM trapezoidal signals, generated by a suitable circuit (not shown) coupled to the decoding logic 84 and driving the bidirectional bus.

Figure 23:
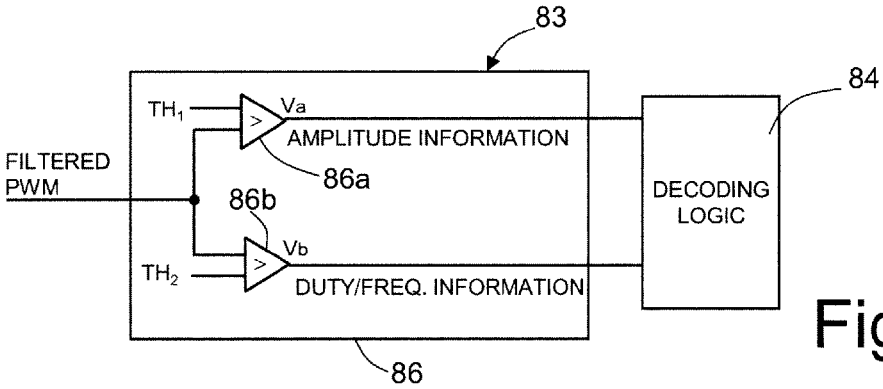
FIG. 23 shows schematically a detection unit in the equipment of FIG. 22.
Figure 24:
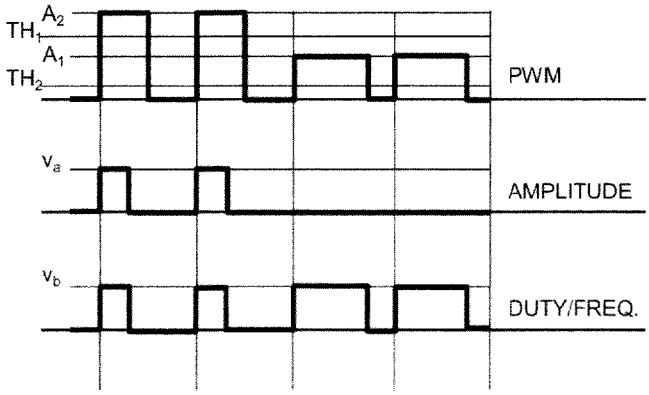
FIG. 24 shows plots of electrical quantities in the equipment of FIG. 22.

As shown in FIG. 23, the detection unit 83 includes a discriminating stage 86 made of a first comparator 86*a* and a second comparator 86*b*, receiving the filtered PWM control signal and adapted to compare the same filtered PWM control signal with a first and, respectively, a second threshold $TH_1$, $TH_2$, for generating a first and, respectively, a second information signal $V_a$, $V_b$ (see also FIG. 24). In particular, the values of the first and second thresholds $TH_1$, $TH_2$ are chosen so that $A_1<TH_1<A_2$, and $TH_2<A_1$, and thus the first information signal $V_a$ detects the amplitude information, while the second information signal $V_b$ detects both duty cycle and frequency information. The first and second information signal $V_a$, $V_b$ are then supplied to the decoding logic 84, that carries out suitable decoding operations in order to determine the duty cycle and frequency for the internal PWM driving signal.

Figure 25:
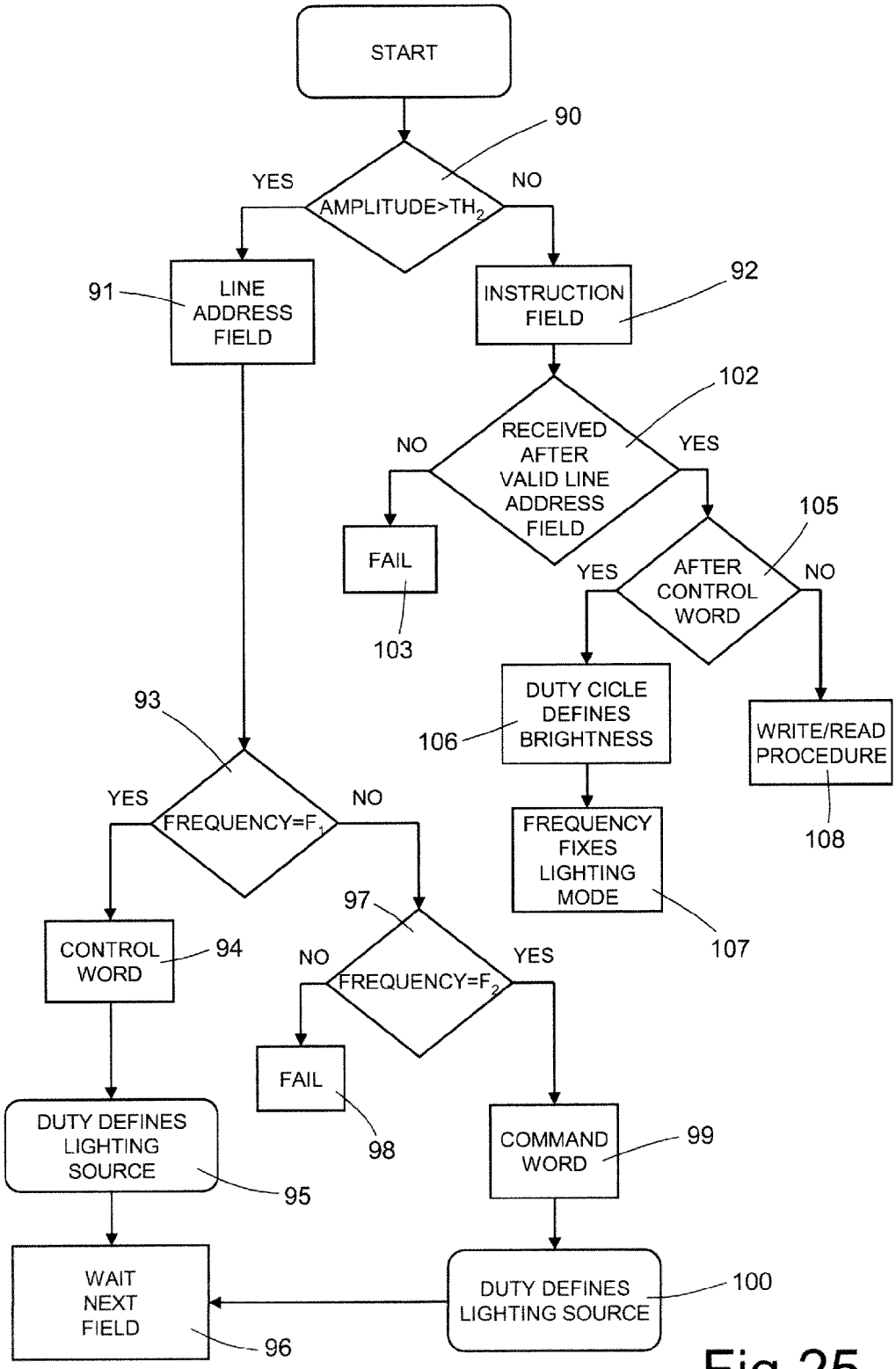
FIG. 25 is a flow diagram of decoding operations executed in a decoding logic of the equipment of FIG. 22.

Exemplary decoding operations carried out by the decoding logic 84 are summarized in FIG. 25, relating to the extension of combination 1.

In detail, decoding logic 84 first checks if the value of the received amplitude information is higher than the second threshold $TH_2$ at block 90: if it is higher, yes exit from block 90, then a "Line Address Field" is decoded, block 91; otherwise, an "Instruction Field" is decoded, block 92. Starting from block 91, if the value of the frequency information corresponds to frequency $F_1$, yes exit from block 93, a Control Word is decoded, block 94, and information about the light source to be driven is decoded from the received duty cycle information at block 95; procedure then waits for a next field of the received signal to be decoded, at block 96. If the frequency information does not correspond to frequency $F_1$, no exit from block 93, and also does not correspond to frequency $F_2$, no exit from block 97, a fail condition is detected by the decoding logic 84 at block 98. Instead, if the frequency information does correspond to frequency $F_2$, yes exit from block 97, a Command Word is decoded, at block 99, and information about the selected light source is decoded from the received duty cycle information, at block 100; procedure then returns to block 96, waiting for the next field. Starting from block 92, if the "Instruction Field" has not been received after a valid "Line Address Field", no exit from block 102, a fail condition is detected by the decoding logic 84 at block 103. Otherwise, yes exit from block 102, and if the "Line Address Field" coded a Control Word, yes exit from block 105, then the decoding logic 84 decodes the required brightness from the duty cycle information, at block 106, and the desired lighting mode from the received frequency information, at block 107, and then issues corresponding amplitude and duty cycle values to the internal waveform generator 11. If the "Line Address Field" coded a Command Word, yes exit from block 105, a WRITE or READ procedure is initiated at block 108 (here not shown), according to the value of the received frequency information, in particular at the register address defined by the received duty cycle information.

It follows that the complexity of the decoding logic 84 will increase with the increase of the coding complexity of the PWM control signal, i.e. with the increase of the lighting management information carried by the same PWM control signal.

The advantages of the lighting system, and related control method, according to the present invention are clear from the foregoing.

In particular, the Applicant has noticed that the use of PWM waveforms both for control and driving signals with controlled shape (i.e. having smooth rising and/or falling edges) and associated controlled frequency spectrum (e.g. having a slope of 40 dB/dec past a desired cut-off frequency) allows to greatly reduce radio frequency emission in the lighting system, without requiring complex and expensive wirings (such as cable shielding and use of twisted or balanced pairs); weight of the system is reduced, flexibility increased and easy maintainability achieved. Trapezoidal waveforms are quite simple to realize and are advantageous when a lot of signals are to be managed. More complex waveforms may be advantageous for PWM driving signals with high current capability, to further reduce RF emission; a squared cosine pulse train or other low emission waveforms may be implemented.

Use of further PWM waveform parameters, other than the duty cycle commonly used to code the brightness information, allows to transfer further information in the PWM control signals for management of the lighting system. In particular, the "simple coding scheme" allows to use another PWM waveform parameter to code a further management information (e.g. the lighting mode information), allowing to remove from the system all discrete signal lines. The "complex coding scheme" allows a further simplification of the system wirings and in particular to have only one single control signal line for each equipment, by using substantially all PWM waveform parameters to transmit management information.

Moreover, use of PWM waveform parameters to code information in conjunction with a suitable protocol, allows to implement a bidirectional communication between the DMCU 3 and the various equipments 4, using the same PWM control signals (so, even without further signal wires between the DMCU and the equipments). This solution allows to perform maintenance operations (which are very important especially in avionics applications), such as failure testing: each equipment 4 is able to monitor itself and send information to the DMCU 3 about its internal conditions. By read and write management operations, it is also possible to read and modify equipment configuration.

It is underlined again that the use of PWM waveform with controlled slope is particularly advantageous in connection with the proposed (simple or complex) coding scheme, in order to further reduce wiring complexity while reducing RF emissions, and that bidirectional communication (and the dedicated protocol) may be implemented with the simple or complex coding scheme, or also with common PWM control signals (i.e. with duty cycle coding, only), or even independently for the control of the light emitted by the lighting system.

Advantageously, the lighting system shall offer a combination of different coding and protocol schemes (i.e. both the simple and the complex coding, the bidirectional communication, and also a traditional PWM control signal with only duty cycle coding), to allow management of old or new designed equipments, off the shelf units, or equipments used on different aircrafts. DMCU in the lighting system may also generate further control and driving signals, such as DC or AC signals, to control or drive different loads (such as traditional incandescent lamps).

In general, a more complex coding scheme requires an increase in the circuit complexity of the decoding circuitry at the equipment side; in particular, PWM complex coding and bidirectional communication are useful with equipments having programmable logic inside (e.g. a FPGA or a microprocessor), and no digital BUS available. In this regard, PWM waveform coding is advantageous with respect to the use of a digital bus, in that: it does not require the presence of a shielding cable; allows management of simple and complex units at the same time, and a reduction of weight and RF emissions; has a high immunity to RF disturbance (in general, improved EMC performances); and has low manufacturing costs.

Finally, numerous modifications and variants can be made to the lighting system according to the present invention, all falling within the scope of the present invention, as defined in the appended claims.

In particular, one or more of the described coding scheme could advantageously be combined in a single solution. For example, the complex coding scheme could be used to manage the brightness and light emitted by the various light sources, and at the same time a line dedicated to maintenance operations could implement the discussed bidirectional communication scheme envisaging writing and reading in the dedicated registers. In this case, the bidirectional communication being independent from the complex coding scheme protocol. In particular, a line dedicated to maintenance operations could be envisaged for each equipment.

Further protocols may be envisaged to manage the lighting system, based on its physical characteristics. For example, a single WRITE information may be exchanged from the DMCU 3 to the equipment 4, instead of the combination of the WRITE command (used, as previously discussed, to code the light source and register indications) and the WRITE message (used to code the content to be written in the register), in the case in which the lighting system includes only a limited number of registers (e.g. one for each light source type). In this case, all the information for the writing procedure can be included in a single WRITE command, wherein: considering the extension of combination 1, amplitude $A_1$ codes the "Line Address Field", frequency $F_2$ defines the command word and duty cycle is used to communicate the register address (and not the light source address); amplitude $A_2$ after the command word codes the "Instruction field", frequency $F_2$ the WRITE command, and duty cycle is used to code the information to be written in the addressed register. A further variant of the protocol could envisage the absence of the AVAILABILITY message transmitted from equipment to DMCU.

Moreover, the described lighting system, even if particularly suited to avionics applications, may advantageously be used in different environments, e.g. safety critical environments, or in different applications, such as in domestic or industrial environments or automotive applications. Also, other light sources than LEDs may be used in the lighting system, such as fluorescent lamps.

What is claimed is:

1. A lighting system of an avionics apparatus, comprising:

at least a light source;

a control unit coupled to the light source and configured to control operation of said light source based on a management PWM signal; and an interface unit coupled to said light source and configured to receive said management PWM signal from said control unit; wherein, during a lighting management mode, said management PWM signal is designed to carry management information for controlling said light source, and said interface unit is operable to decode said management information from said management PWM signal for driving said light source accordingly, and wherein said control unit is configured to code said management information using a first waveform parameter of said management PWM signal, and at least a second waveform parameter of said management PWM signal, different from said first waveform parameter.

2. The lighting system according to claim 1, wherein said control unit is configured to code a first information using said first waveform parameter of said management PWM signal, and to code at least a second information using at least said second waveform parameter of said management PWM signal.

3. The lighting system according to claim 2, wherein said first information is a brightness level of said light source and said second information is a lighting mode of said light source.

4. The lighting system according to claim 1, wherein said first and second waveform parameters are one of a duty cycle, an amplitude and a frequency of said management PWM signal.

5. The lighting system according to claim 1, wherein said interface unit is coupled to said control unit only via one signal line carrying said management PWM signal.

6. The lighting system according to claim 1, wherein said control unit is configured to transmit said management information in said management PWM signal according to a transmission protocol, envisaging a first and at least a second field; said first waveform parameter of said management PWM signal coding the presence of said first field or second field in said management PWM signal, and management information coded by said second waveform parameter, and/or by further waveform parameters of said PWM signal, being a function of the presence of said first or second field.

7. The lighting system according to claim 6, including a plurality of further light sources; wherein said first field is an address field and said second field is an instruction field following said address field, said second waveform parameter coding an address of said light sources in said first field, and a brightness level of the addressed light source in said second field.

8. The lighting system according to claim 7, wherein said control unit is configured to code said management information using also a third waveform parameter of said management PWM signal, different from said first and second waveform parameters; said third waveform parameter coding a lighting mode of said addressed light source in said second field.

9. The lighting system according to claim 6, including a plurality of further light sources grouped according to different light source types; said interface unit being coupled to all the light sources of said light source types, and being coupled to said control unit only via one signal line carrying said management PWM signal.

10. The lighting system according to claim 6, further including at least one storage element coupled to said light source; wherein said transmission protocol associated to said management PWM signal also envisages a bidirectional communication between said control unit and said interface unit, by means of which management data are read from, and/or written to, said storage element.

11. The lighting system according to claim 10, wherein said bidirectional communication is implemented via a dedicated communication line.

12. The lighting system according to claim 10, wherein one of said second or further waveform parameters of said PWM signal, different from said first waveform parameter, is operable to code, in said first field, the presence of said lighting management mode, or of a bidirectional communication mode, during which said bidirectional communication is implemented.

13. The lighting system according to claim 12, wherein said control unit is configured to code said management information using also a third waveform parameter of said management PWM signal, different from said first and second waveform parameters; said third waveform parameter coding, in said first field, the presence of said lighting management mode or of said bidirectional communication mode.

14. The lighting system according to claim 13, wherein said first field is an address field and said second field is an instruction field; said third waveform parameter coding in said first field a command word or a control word denoting, respectively, the presence of said bidirectional communication mode or of said lighting management mode, and coding in said second field: after a command word, the presence of a read or a write command; and, after a control word, a lighting mode of the addressed light source; said second waveform parameter coding in said first field an address of said light sources, and coding in said second field: after a command word, information for said bidirectional communication; and, after a control word, a brightness level of the addressed light source.

15. The lighting system according to claim 14, including a number of further storage elements coupled to said light source, wherein said second waveform parameter codes in said second field, after a command word, an address corresponding to a selected storage element to be read or written; and wherein, after a second field containing said write command, said control unit is configured to transmit in said management PWM signal a message containing management data to be written in said selected storage element; said management data being coded using one or more of said first, second and further waveform parameters of said management PWM signal.

16. The lighting system according to claim 15, wherein said interface unit is coupled to said control unit only via one signal line; and wherein, after said read command, said interface unit is configured to transmit to said control unit via said signal line a response PWM signal carrying management data read from said storage element.

17. The lighting system according to claim 12, wherein said interface unit is coupled to said control unit only via one signal line; and wherein, during said bidirectional communication mode, said interface unit is configured to transmit to said control unit via said signal line a response PWM signal carrying information on a write procedure, coded using one or more waveform parameters of said response PWM signal.

18. The lighting system according to claim 10, wherein said bidirectional communication mode is implemented during maintenance or test operations in said lighting system.

19. The lighting system according to claim 6, including at least one equipment provided with said interface unit and said light source; wherein said interface unit comprises: a detection unit configured to extract amplitude, duty cycle and frequency information from said management PWM signal; a decoding logic configured to decode said amplitude, duty cycle and frequency information in view of said transmission protocol, and to generate amplitude and duty cycle driving values for a driving PWM signal to be supplied to said light source.

20. The lighting system according to claim 1, wherein said light source includes a LED.

21. The lighting system according to claim 1, wherein said management PWM signal has a shape that limits radio frequency emissions.

22. The lighting system according to claim 21, wherein said management PWM signal has a waveform with smooth rising and/or falling edges, determining non-zero rise and/or fall times.

23. The lighting system according to claim 22, wherein a desired attenuation pattern of said radio frequency emissions corresponds to a value of said rise and fall times.

24. The lighting system according to claim 21, wherein said waveform is chosen between: a trapezoidal waveform; a squared cosine waveform; and a waveform having rising and/or falling edges with a squared-cosine pattern and a flat top portion.

25. The lighting system according to claim 21, including a waveform generator configured to generate said management PWM signal; said waveform generator comprising a filtering stage configured to receive a PWM square wave with variable duty cycle, and to filter said PWM square wave to generate an output PWM signal with a desired frequency spectrum.

26. An avionics apparatus, including a lighting system, comprising:

at least a light source;

a control unit coupled to the light source and configured to control operation of said light source based on a management PWM signal; and an interface unit coupled to said light source and configured to receive said management PWM signal from said control unit; wherein, during a lighting management mode, said management PWM signal is designed to carry management information for controlling said light source, and said interface unit is operable to decode said management information from said management PWM signal for driving said light source accordingly, and wherein said control unit is configured to code said management information using a first waveform parameter of said management PWM signal, and at least a second waveform parameter of said management PWM signal, different from said first waveform parameter.

27. A method for controlling a lighting system of an avionics apparatus having at least a light source, said method comprising controlling operation of said light source based on a management PWM signal, which carries management information for controlling said light source, the method comprising:

coding, by a control unit (3) of said lighting system during a lighting management mode, said management information using a first waveform parameter of said management PWM signal, and at least a second waveform parameter of said management PWM signal, different from said first waveform parameter; and decoding, by an interface unit of said lighting system, said management information for driving said light source.

28. The control method according to claim 27, further comprising transmitting said management information in said management PWM signal according to a transmission protocol, envisaging a first and at least a second field; said step of coding including coding the presence of said first or second field with said first waveform parameter of said management PWM signal, and coding with said second waveform parameter, and/or further waveform parameters of said PWM signal, management information, which are a function of the presence of said first or second field.

29. The control method according to claim 28, wherein said lighting system includes a plurality of further light sources; wherein coding comprises coding, with said second waveform parameter, an address of said light sources in said first field, and a brightness level of the addressed light source in said second field; said first field being an address field, and said second field an instruction field following said address field.

30. The control method according to claim 28, wherein said lighting system includes at least one storage element coupled to said light source; wherein transmitting implements a bidirectional communication between said control unit and said interface unit, by means of which management data are read from, and/or written to, said storage element.

31. The control method according to claim 30, wherein coding includes coding in said first field, with one of said second or further waveform parameters of said PWM signal, different from said first parameter, the presence of said lighting management mode, or of a bidirectional communication mode during which said bidirectional communication is implemented.

32. The control method according to claim 31, wherein coding includes coding said management information using also a third waveform parameter of said management PWM signal, different from said first and second waveform parameters; said third waveform parameter coding, in said first field, the presence of said lighting management mode or of said bidirectional communication mode.

33. The control method according to claim 27, wherein controlling includes generating said PWM management signal having a shape that limits to limit radio frequency emissions.

34. The control method according to claim 33, wherein said management PWM signal has a waveform with smooth rising and/or falling edges, determining non-zero rise and/or fall times; wherein controlling includes controlling the duration of said rise and/or fall times as a function of a desired attenuation pattern of said radio frequency emissions.

35. A method for controlling an avionics apparatus, comprising:

controlling a lighting system having at least a light source, said method comprising controlling operation of said light source based on a management PWM signal, which carries management information for controlling said light source, the method comprising:

coding, by a control unit of said lighting system during a lighting management mode, said management information using a first waveform parameter of said management PWM signal, and at least a second waveform parameter of said management PWM signal, different from said first waveform parameter; and decoding, by an interface unit of said lighting system, said management information for driving said light source.

36. A computer program product comprising program code configured to implement, when executed in a control unit of a lighting system, wherein the control unit is coupled to a light source and configured to control operation of said light source based on a management PWM signal, a method comprising:

controlling operation of said light source based on a management PWM signal, which carries management information for controlling said light source, comprising, during a lighting management mode:

coding, by a control unit of said lighting system, said management information using a first waveform parameter of said management PWM signal, and at least a second waveform parameter of said management PWM signal, different from said first waveform parameter; and decoding, by an interface unit of said lighting system, said management information for driving said light source.

* * * * *